US012247327B2

(12) United States Patent
Sick et al.

(10) Patent No.: US 12,247,327 B2
(45) **Date of Patent: *Mar. 11, 2025**

(54) METHOD OF DELAYING AND REDUCING TEXTURE REVERSION OF A TEXTURED ARTIFICIAL TURF YARN

(71) Applicant: Polytex Sportbelage Produktions-GmbH, Grefrath (DE)

(72) Inventors: Stephan Sick, Willich-Neersen (DE); Dirk Sander, Kerken (DE); Bernd Jansen, Nettetal (DE); Ivo Lohr, Kempen (DE); Kris Brown, Dalton, GA (US)

(73) Assignee: Polytex Sportbeläge Produktions-GmbH, Grefrath (DE)

( * ) Notice: Subject to any disclaimer, the term of this patent is extended or adjusted under 35 U.S.C. 154(b) by 0 days.

This patent is subject to a terminal disclaimer.

(21) Appl. No.: 18/298,616

(22) Filed: Apr. 11, 2023

(65) Prior Publication Data

US 2023/0243072 A1 Aug. 3, 2023

Related U.S. Application Data

(63) Continuation of application No. 16/651,689, filed as application No. PCT/EP2018/077193 on Oct. 5, 2018, now Pat. No. 11,655,566.

(Continued)

(30) Foreign Application Priority Data

| | | |
|---|---|---|
| Oct. 6, 2017 | (EP) | 17195136 |
| Nov. 17, 2017 | (EP) | 17202272 |
| Jul. 23, 2018 | (EP) | 18185033 |

(51) Int. Cl.
*B29C 33/02* (2006.01)
*B29C 33/04* (2006.01)
(Continued)

(52) U.S. Cl.
CPC ..... *D02G 1/165* (2013.01); *D01F 1/106* (2013.01); *D01F 8/06* (2013.01); *D01F 8/12* (2013.01);
(Continued)

(58) Field of Classification Search
CPC ..... B29C 33/02; B29C 33/04; B29C 33/06; C08J 3/22; D01D 1/04; D01D 5/12;
(Continued)

(56) References Cited

U.S. PATENT DOCUMENTS 3,409,956 A 11/1968 Longbottom et al.
4,631,790 A * 12/1986 Nabulon ..... D02G 1/122 28/255

(Continued)

FOREIGN PATENT DOCUMENTS

EP 0163039 B1 5/1988
EP 0282815 B1 2/1991

(Continued)

OTHER PUBLICATIONS

International Search Report dated Dec. 7, 2018, issued in corresponding International Application No. PCT/EP2018/077193.

(Continued)

*Primary Examiner* — Leo B Tentoni
(74) *Attorney, Agent, or Firm* — Harness, Dickey & Pierce, P.L.C.

(57) ABSTRACT

The invention provides for a method of delaying and reducing texture reversion of a textured artificial turf yarn (145), characterized by using a stretched and textured monofilament yarn as the textured artificial turf yarn, the stretched and textured monofilament yarn comprising a polymer mixture (400, 500), wherein the polymer mixture is at least a three-phase system, wherein the polymer mixture comprises a first polymer (402), a second polymer (404), and a com- (Continued)

patibilizer (406), wherein the first polymer and the second polymer are immiscible, wherein the first polymer forms polymer beads (408) surrounded by the compatibilizer within the second polymer.

19 Claims, 10 Drawing Sheets

Related U.S. Application Data

(60) Provisional application No. 62/643,428, filed on Mar. 15, 2018.

(51) Int. Cl.

| | |
|---|---|
| ***B29C 33/06*** | (2006.01) |
| ***C08J 3/22*** | (2006.01) |
| ***D01D 1/04*** | (2006.01) |
| ***D01D 5/12*** | (2006.01) |
| ***D01D 5/22*** | (2006.01) |
| ***D01D 5/36*** | (2006.01) |
| ***D01F 1/04*** | (2006.01) |
| ***D01F 1/07*** | (2006.01) |
| ***D01F 1/10*** | (2006.01) |
| ***D01F 8/04*** | (2006.01) |
| ***D01F 8/06*** | (2006.01) |
| ***D01F 8/12*** | (2006.01) |
| ***D01F 8/14*** | (2006.01) |
| ***D01F 8/16*** | (2006.01) |
| ***D02G 1/12*** | (2006.01) |
| ***D02G 1/16*** | (2006.01) |
| ***D02J 1/22*** | (2006.01) |
| ***E01C 13/08*** | (2006.01) |

(52) U.S. Cl.
CPC ..... *D01F 8/14* (2013.01); *D01F 8/16* (2013.01); *D02G 1/12* (2013.01); *D02G 1/161* (2013.01); *D02G 1/167* (2013.01); *E01C 13/08* (2013.01); *D10B 2505/18* (2013.01); *D10B 2505/202* (2013.01)

(58) Field of Classification Search
CPC ... D01D 5/16; D01D 5/22; D01D 5/36; D01F 1/04; D01F 1/07; D01F 1/10; D01F 1/106; D01F 8/04; D01F 8/06; D01F 8/12; D01F 8/14; D02G 1/16; D02G 1/161; D02G 1/165; D02G 1/167; D02J 1/22; D10B 2505/202; E01C 13/08
USPC ..... 264/40.6, 103, 168, 172.13, 172.17, 264/172.18, 210.2, 210.4, 210.6, 210.8, 264/211, 290.5, 290.7, 331.17, 331.19, 264/331.21, 402, 403, 404; 28/249, 255, 28/271; 523/351
See application file for complete search history.

(56) References Cited

U.S. PATENT DOCUMENTS

| | | | | |
|---|---|---|---|---|
| 4,854,019 | A * | 8/1989 | Nabulon | D02G 1/122 28/255 |
| 2004/0014386 | A1 | 1/2004 | Soelch et al. | |
| 2010/0285246 | A1 | 11/2010 | Becker et al. | |

FOREIGN PATENT DOCUMENTS

| | | | |
|---|---|---|---|
| EP | 0522995 | A2 | 1/1993 |
| JP | S6119811 | A | 1/1986 |
| WO | WO-2015/144223 | A1 | 10/2015 |

OTHER PUBLICATIONS

Written Opinion dated Dec. 7, 2018, issued in corresponding International Application No. PCT/EP2018/077193.
C. Prior et al., 'Ribbon curling via stress relaxation in thin polymer films' *PNAS*, vol. 113, No. 7, Feb. 2016, pp. 1719-1724.
F. Fourne et al., "BCF (Bulked Continuous Filament) Texturizing in 'Synthetic Fibers'" Chapter 4.12.6, 1999, pp. 456-460.
International Preliminary Report on Patentability dated Oct. 1, 2019, issued in corresponding International Application No. PCT/EP2018/077193.
Office Action for European Application No. 18 779 409.4 dated May 3, 2021.

* cited by examiner

METHOD OF DELAYING AND REDUCING TEXTURE REVERSION OF A TEXTURED ARTIFICIAL TURF YARN

CROSS-REFERENCE TO RELATED APPLICATIONS

This application is a continuation of U.S. patent application Ser. No. 16/651,689, filed Mar. 27, 2020, now U.S. Pat. No. 11,655,566, which is a national phase under 35 U.S.C. § 371 of PCT International Application No. PCT/EP2018/077193 which has an International filing date of Oct. 5, 2018, which claims priority to European Patent Application No. 18185033.0, filed Jul. 23, 2018, U.S. Provisional Application No. 62/643,428, filed Mar. 15, 2018, European Patent Application No. 17202272.5, filed Nov. 17, 2017, and European Patent Application No. 17195136.1, filed Oct. 6, 2017, the entire contents of each of which are hereby incorporated by reference.

FIELD OF THE INVENTION

This invention relates to artificial turf, and more particularly to a method of delaying and reducing texture reversion of a textured artificial turf yarn.

BACKGROUND AND RELATED ART

Artificial turf or artificial grass is a material that is made up of textured fibers used to replace natural grass. The structure of the artificial turf is designed such that the artificial turf has an appearance which resembles natural grass. Typically artificial turf is used as a surface for sports such as soccer, American football, rugby, tennis, golf, and for playing fields or exercise fields. Furthermore, artificial turf is frequently used for landscaping applications.

Artificial turf may be manufactured using techniques for manufacturing carpets. For example, artificial turf fibers which have the appearance of grass blades may be tufted or attached to a backing. Artificial turf does not need to be irrigated or trimmed and has many other advantages regarding maintenance effort and other aspects. Irrigation can be difficult due to regional restrictions for water usage. In other climatic zones the re-growing of grass and re-formation of a closed grass cover is slow compared to the damaging of the natural grass surface by playing and/or exercising on the field. Artificial turf does not need sunlight and thus can be used in places where there is not enough sunlight to grow natural grass. To ensure that artificial turf replicates the playing qualities of good quality natural grass, artificial turf needs to be made of materials that will not increase the risk of injury to players and that are of adequate durability. Many sports fields are subjected to high-intensity use relating to player-to-surface interactions and ball-to-surface interactions. The surface of the artificial turf fibers must be smooth enough to prevent injuries to the skin of the players when sliding on the surface, but at the same time must be sufficiently embedded into the substructure to prevent the fibers from coming loose. Thus, the materials used for producing artificial turf must have highly specific properties regarding smoothness, brittleness, resistance to shear forces, etc. In addition, changes in these properties have to be minimized when the artificial turf is exposed to the mechanical and/or weathering stress.

The gas-dynamic texturizing process employing heated compressed gas is often used for manufacturing of texturized filaments. This process is also called bulked continuous filament texturizing (Chapter 4.12.6 "BCF (Bulked Continuous Filament) Texturizing in "Synthetic Fibers" by Franz Fourné, Carl Hanser Verlag GmbH & Co, 1999, ISBN 10: 3446160728/ISBN 13: 9783446160729, pp. 456-460).

The patents EP 0 282 815 B1 and EP 0 163 039 B1 disclose a texturing apparatus for gas-dynamic texturizing of endless filament threads.

SUMMARY

The following definitions are provided to determine how terms used in this application, and in particular, how the claims, are to be construed. The organization of the definitions is for convenience only and is not intended to limit any of the definitions to any particular category.

A "polymer blend," as understood herein, is a mixture of polymers, which can have different types (e.g., different types of the same polymer, such as different types of polyethylene), a mixture of at least two different polymers (such as two miscible polymers), mixture of at least three polymers (such as two immiscible polymers and a compatibilizer), or a combination thereof. A single polymer can have at least two phases such as amorphous and crystalline. The polymer blend can comprise various additives added to the polymer mixture. The polymer blend can be at least a two or three-phase system. A three-phase system as used herein encompasses a mixture that separates out into at least three distinct phases. The polymer blend can be a mixture of at least a first polymer, a second polymer, and a compatibilizer. These three items form the phases of the three-phase system. If there are additional polymers or compatibilizers added to the system then the three-phase system may be increased to a four, five, or more phase system. The first polymer and the second polymer are immiscible. The first polymer forms polymer beads surrounded by the compatibilizer within the second polymer.

A polymer blend may also be composed of compatible and miscible polymeric components. Compatibility means, as understood herein, that blending of, e.g., two distinct polymers, leads to an enhancement of at least one desired property, when comparing the blend to one of the two individual blend components. Ideally, the performance of the blend lies in between the range, which is flanked by the two blend components, in fact, in strong relationship to the concentration ratio. However, compatibility is only given in some exceptional cases, mostly related to completely amorphous polymers. In nearly all other polymer mixtures, an enhancement of properties fails and the resulting blend stays far behind the property profile of the individual blend components. Polymer miscibility, as used here, is meant in a thermodynamic sense and can be compared to solubility. Completely miscible polymers form a single phase continuity upon mixing, i.e., one component is fully dispersed in the other component. This is in most cases true for amorphous polymers, but it is a rare case for semi-crystalline polymers. Complete miscibility would also require co-crystallization of the crystalline phase. This explicitly would affect the melting behavior of polymeric blends.

The term "polymer blend," as understood herein, encompasses the term "polymer mixture". The term "blend," as understood herein, encompasses both a physical mixture of polymer particles on a macroscopic scale and a dispersion of polymers on a molecular scale.

The term "artificial turf yarn" encompasses the term "monofilament yarn". The term "textured (curled) artificial turf yarn" encompasses the term "textured (curled) monofilament yarn".

The term "expansion chamber" of the texturing apparatus for gas-dynamic texturing of an artificial turf yarn encompasses the term "stuffer box" of the texturing apparatus for gas-dynamic texturing of an artificial turf yarn.

The terms "polymer bead" and "beads" may refer to a localized region, such as a droplet, of a polymer that is immiscible in the second polymer. The polymer beads may in some instances be round or spherical or oval-shaped, but they may also be irregularly shaped. In some instances the polymer bead will typically have a size of approximately 0.1 to 3 micrometers, preferably 1 to 2 micrometers in diameter. In other examples, the polymer beads will be larger. They may, for instance, have a diameter up to 50 micrometers.

The term "polymorphism" or "polymorphic modification," as used herein, refers to the fact that solid matter is able to exist in different forms of crystal structures. This may include not only different crystallographic unit cells but different crystal imperfections as well. The polymer blend or mixture can comprise at least one polymer having different polymorphic modifications.

The "melting temperature" is, as understood here, a characteristic temperature of a polymer blend, at which at least a portion of a crystalline fraction of one of the polymers of the polymer blend melts. In the case when a crystalline fraction of the polymer of the polymer blend has polymorphism, then the polymorphic modification of the polymer having polymorphism has a respective melting temperature at which at least a portion of the polymer has polymorphism. Melting at the melting temperature is a process wherein the thermal energy in a crystalline fraction of a polymer is sufficient to overcome the intermolecular forces of attraction in the crystalline lattice so that the lattice breaks down and at least a portion of the crystalline fraction becomes a liquid, i.e., it melts. Further in the text, the term "melting temperature" of a polymer refers to a melting process of its crystalline fraction without explicit reference to the latter. This formulation is in conformity with the general practice, because purely crystalline polymers are very rarely used and are quite difficult, if not impossible, to produce.

The "sigmoid (sigmoidal) function" is, as understood here, a limited function having non-positive or non-negative derivative and a characteristic S-shaped curve. The sigmoid function can be, for instance, the logistic function expressed by the following formula: $S(x)=1/(1+\exp(-x))$.

Utilization of textured (curled) yarns in artificial turf carpets may provide for the above-mentioned required properties of the artificial turf carpets. Textured yarns are different from flat monofilament yarns in that they are irregularly crimped. The textured yarns exhibit a zig-zag shape having at least one of the characteristic features such as kinks, jogs, bends, crinkles, buckling, and curls. These features make the textured yarns more voluminous and soft when manufactured into artificial turf, compared to flat monofilament fibers. The textured yarn may also be advantageous over flat yarn concerning the capability of holding infill material in its place, i. e. reducing the splash of infill material when, e. g. a ball hits the ground.

The "texture reversion" (or "texturing reversion") of a textured (curled) artificial turf yarn is, as understood herein, a process of smoothing out of the crimps of the textured (curled) artificial turf yarn, when the textured (curled) artificial turf yarn is subjected to a mechanical and/or weathering stress. The mechanical stress can be caused by sportsmen using the artificial turf with the textured (curled) artificial turf yarn. The weathering stress can be caused by weather conditions at place where the artificial turf with the textured (curled) artificial turf yarn is installed. The weathering stress comprises at least one of the following: temperature changes, water exposure, snow exposure, icing, light exposure (in particular ultraviolet light exposure). For instance, the properties of the textured turf yarn of an artificial turf (e.g. softness and voluminous appearance) can degrade throughout its lifetime/utilization due to the texture reversion. The weathering stress and/or the mechanical stress can be natural or produced in a laboratory environment. The details of the laboratory environment for the (accelerated) weathering and/or mechanical stress are described further below.

In addition, it is necessary to mention, that the phenomenon of the texture reversion is a newly observed effect, which is not yet reported in the state of art literature. For instance the publication "Ribbon curling via stress relaxation in thin polymer films" discloses an observation that the texturing of the filament made of polymer film remains permanent ("Ribbon curling via stress relaxation in thin polymer films", Proceedings of the National Academy of Sciences of the United States of America, vol. 113, no. 7, pp. 1719-1724, http://www.pnas.org/content/113/7/1719).

The texture reversion of a fragment of a single textured artificial turf yarn, which may be integrated into an artificial turf backing, can be assessed by employing the following example method: hanging the fragment, such that the fragment is unfolded by gravity in a vertical direction; measuring a distance D1 between the ends of the hanged fragment; subjecting the fragment to a mechanical and/or weathering stress, which may be caused by utilization of an artificial turf comprising said fragment and said artificial turf backing; performing the following after the subjecting of the fragment to the mechanical and/or weathering stress: hanging the fragment, such that the fragment is unfolded by gravity in the vertical direction; measuring a distance D2 between the ends of the hanged fragment.

The degree of the texture reversion can be characterized by the following value $A1=(D2-D1)/(D1)$. The value A1 can be used for comparison of the degree of the texture reversion in different samples on condition that the samples were subjected the same mechanical and/or weathering stress for the same time. In addition, the samples must have the same or substantially similar degree of shrinkage produced in the texturing process. The degree of shrinkage is characterized by the following value $A0=(D01-D02)/D01$, wherein D01 is a length of the yarn sample before the texturing process and D02 is a length of the same sample after the texturing process. The samples have substantially similar degree of shrinkage when their shrinkage values (A0) differ from each other less than 10%, preferably less than 5%. In addition, the samples which degree of the texture reversion is compared, preferably have the same or substantial similar length and/or cross-section. The samples have substantial similar length (cross-section), when their lengths (cross-sections) differ from each other less than 10%, preferably less than 5%.

The mechanical stress can be a tension force of 1 N applied to both ends of a sample of a single textured artificial turf yarn for a predetermined interval of time, e.g. 24 hours. The mechanical stress can be applied at room temperature, e.g. at 20 degrees Celsius or at elevated temperature, e.g. at 70 degrees Celsius. Such a mechanical test is often called as accelerated and/or laboratory mechanical stress.

The mechanical stress can be a natural one. For instance, the natural mechanical stress can be caused by using a sample of a single textured artificial turf yarn in an artificial turf used for particular (sports) activity for a predetermined interval of time.

The weathering stress test can be an weathering test, wherein a sample is exposed to high temperature (e.g. 60 degrees Celsius), and/or high humidity (e.g. 80%), and/or intensive ultraviolet illumination (e.g. 0.35 $W/m^2$ at wavelength of 340 nm). The duration of the weathering test can be in a range from 1 day to several weeks. Any combination of the factors (high temperature, high humidity, intensive ultraviolet illumination) can be used in the weathering test. Such a weathering test is often called as accelerated and/or laboratory weathering test.

The weathering stress can be a natural one. For instance, the natural weathering stress can be caused by using a sample of a single textured artificial turf yarn in an artificial turf installed indoors or outdoors for a predetermined interval of time.

The first and/or the second value can be used for optimization of manufacturing tools for manufacturing of the textured artificial turf yarn, parameters of processes for manufacturing of the textured artificial turf yarn, phase and/or chemical composition of filaments used as an ingot for manufacturing of the textured artificial turf yarn. The optimization can be targeted towards reduction in the first and/or second value, whereas fragments of different filaments are subjected to the same (test) mechanical and/or weathering stress, wherein the different filaments are manufactured using different tools, different process parameters, and/or different ingots. A similar approach can be implemented using characteristic values of fiber texturing generated using the aforementioned optical means.

The invention provides for a method for delaying and reducing texture reversion of a textured (curled) artificial turf yarn as formulated in the independent claim. Embodiments are given in the dependent claims.

The system for manufacturing of textured artificial tuft yarn is configured to perform the gas-dynamic texturizing process employing heated compressed fluid (air). This process is also called bulked continuous filament (BCF) texturizing. The BCF process produces good textured effect and matches the spinning speed of reel-to-reel yarn manufacturing (100-1000 m/min).

In one aspect the invention provides for a system for a gas-dynamic texturing of an artificial turf yarn. The texturing system comprises: a texturing apparatus comprising an inlet for a fluid under pressure for gas-dynamic texturing of the artificial turf yarn in the texturing device, wherein the fluid has a temperature above ambient temperature; an apparatus heating device being configured to heat the texturing apparatus by electromagnetic induction or through physical contact with the texturing apparatus. The fluid can be for instance hot air. The apparatus heating device configured to heat the texturing apparatus through physical contact can be an electrical resistance heater. The artificial turf yarn can be a monofilament yarn. Electromagnetic induction heating can heat electrically conducting components of the texturing apparatus by electromagnetic induction, through heat generated in the components by eddy currents. An apparatus heating device configured to heat the texturing apparatus by electromagnetic induction can comprise an electromagnet and an electronic oscillator that passes a high-frequency alternating current (AC) through the electromagnet. The rapidly alternating magnetic field penetrates the texturing device, generating electric currents (eddy currents) inside the electrically conducting components. The eddy currents flowing through the resistance of the material heat it by Joule heating. In ferromagnetic (and ferrimagnetic) materials like iron, heat may also be generated by magnetic hysteresis losses.

Such a configuration of the texturing system can provide the following advantages. First, it can be more energy efficient in comparison with the texturing system in which the texturing apparatus is heated only by a hot fluid. The apparatus heating device can ramp-up the temperature of the texturing apparatus from ambient temperature to the desired temperature (temperature of the texturing process) much faster in comparison with the case when only hot fluid (e.g. hot air) provides the heating of the texturing apparatus. As a result thereof idle time of the texturing system is reduced. Second, the texturing system can provide for an advanced process control. When the apparatus texturing device is not used the fluid parameters such as flow and temperature have to be tuned such that the texturing apparatus has the desired process temperature and the flow of the fluid in the texturing apparatus (e.g. in a yarn channel of the texturing apparatus and/or in an expansion chamber of the texturing apparatus) has optimal gas-dynamic properties for the texturing process. This is not the case when the apparatus heating device is employed. In this case the heating of the texturing apparatus is primarily provided by the apparatus heating device, whereas the flow of the fluid can be tuned primarily (or only) for the purpose of achieving optimal gas-dynamic properties of the fluid flow in the texturing apparatus. Third, the heating by the apparatus heating device can be more efficient as such in an operating mode in comparison with the case when the texturing apparatus is heated exclusively by the fluid. Fourth, the consumption of the fluid can be much less when the apparatus heating device is used. In this case the hot fluid is used primarily for generating the fluid flow in the texturing device, i.e. there is no need to provide high flow of the hot fluid in order to heat the texturing device.

The advanced process control (such as providing more stable temperature of the texturing process and/or optimal gas-dynamic properties of the fluid used for the texturing process) provided by the features of the texturing apparatus described above and/or further in the text can be of particular advantage for manufacturing of a (stretched and) textured monofilament yarn with reduced and/or delayed texture reversion, when the (stretched and) textured monofilament yarn is used as the textured artificial yarn in an artificial turf.

The temperature of the fluid can be in the range of 50-150 degrees Celsius, preferably in the range 70-130 degrees Celsius, more preferably in the range of 90-110 degrees Celsius. The range of 90-110 degrees Celsius can be optimal for a polymer bled prepared comprising linear low-density polyethylene (LLDPE) and high-density polyethylene (HDPE). The range of 90-100 degrees Celsius can be optimal for a polymer blend comprising polyamide and polyethylene. This polymer blend (mixture) can be of particular advantage for manufacturing of a (stretched and) textured monofilament yarn with reduced and/or delayed texture reversion, when the (stretched and) textured monofilament yarn is used as the textured artificial yarn in the artificial turf. The apparatus heating device can be configured to heat the texturing apparatus such that its temperature differs from the temperature of the fluid less than 10%, preferably less than 5%, more preferably less than 0.5%.

In another embodiment, the texturing system comprises a first temperature sensor configured to sense a temperature of the texturing apparatus and a first controller coupled to the first temperature sensor, wherein the first controller is configured to control the apparatus heating device such that the temperature of the texturing apparatus is held at a first desired temperature.

This embodiment can be advantageous, because it can provide for an effective temperature control of the texturing apparatus.

In another embodiment, the texturing apparatus comprises: a yarn channel for the fluid; means for entraining of the artificial turf yarn so that it runs concurrently with the fluid in the yarn channel; and an expansion chamber leading out of the yarn channel downstream thereof, wherein the apparatus heating device is configured to heat the yarn channel and/or the expansion chamber. The apparatus heating device configured to heat the texturing apparatus through physical contact can be affixed to the yarn channel and/or to the expansion chamber such that the heating device is in direct physical contact with the yarn channel and/or the expansion chamber. A solid medium (e.g. thermally conductive paste) can be used in between (components of) the texturing apparatus and the device in order to facilitate heat transfer between these components.

This embodiment can be advantageous because the heating device is configured to heat the critical components of the texturing apparatus, in which the texturing process takes place.

In another embodiment, the texturing apparatus comprises: a housing; a yarn channel for the fluid; means for entraining of the artificial turf yarn so that it runs concurrently with the fluid in the yarn channel; and an expansion chamber leading out of the yarn channel downstream thereof, wherein the yarn channel is arranged within the housing and thermally coupled thereto, wherein the expansion chamber is at least partially arranged within the housing and thermally coupled thereto, wherein the apparatus heating device is configured to heat at least one of the following components: the yarn channel, the expansion chamber, and the housing. The apparatus heating device configured to heat the texturing apparatus through physical contact can be affixed to any of the aforementioned components, such that the heating device is in direct physical contact with any of the aforementioned components. A solid medium (e.g. thermally conductive paste) can be used in between (components of) the texturing apparatus and the device in order to facilitate heat transfer between these components.

This embodiment can be advantageous because the heating device can be configured to heat the critical components of the texturing apparatus such as the yarn channel and the expansion chamber. The heating device configured to heat the housing has another advantage. In this case the heating element can be mounted on (or arranged around) an external surface the housing. In this case the integration of the heating device does not compromise any design considerations for internal components of the texturing apparatus.

In another embodiment, the expansion chamber has a diameter greater than that of the yarn channel to allow for rapid expansion of the fluid therein, wherein the texturing apparatus comprises fluid exhaust means for egress of the fluid from the expansion chamber independently of egress of the artificial turf yarn.

This embodiment can be advantageous because it can provide for optimal gas-dynamic properties of the fluid flow in the critical components of the texturing apparatus.

In another embodiment, the texturing system comprises: a fluid heating element for heating the fluid; a second temperature sensor configured to sense a temperature of the fluid; and a second controller coupled to the second temperature sensor, wherein the second controller is configured to control the fluid heating element such that the temperature of the fluid is held at a second desired temperature.

This embodiment can be advantageous, because it can provide for an advanced process control and repeatability. The controlled heating of the fluid and the texturing apparatus can result in a more stable temperature of the texturing process.

In another embodiment, an inner wall of the housing and an outer wall of a conduit of the yarn channel constitute a channel for guiding the fluid into the yarn channel, wherein the second temperature sensor is positioned in the channel.

This embodiment can be advantageous because it can provide for an optimal positioning of the second temperature sensor for sensing the fluid temperature in the texturing apparatus immediately before it enters the components of the texturing apparatus (such as yarn channel) in which the texturing process takes place. In this case eventual changes in the fluid temperature in the fluid distribution system (e.g. gas pipe lines) and/or in the texturing apparatus can be effectively compensated.

In another embodiment, the inlet for the fluid under pressure comprises an inlet pipe, wherein the second temperature sensor is positioned in the inlet pipe.

This embodiment can be advantageous because it can provide for a second temperature sensor positioned such, that its positioning does not compromise any other design considerations of the texturing apparatus.

In another embodiment, the second desired temperature and the first desired temperature are equal. Alternatively they can differ from each other less than 10%, preferably less than 5%, more preferably less than 0.5%.

This embodiment can be advantageous, because it can provide for an advanced thermal stability of the texturing process.

In another embodiment, the fluid exhaust means comprise openings in a side wall of the expansion chamber, wherein the texturing system comprises cleaning means for cleaning the openings.

This embodiment can be advantageous because it can provide for an advanced process repeatability. The clogging of the openings by debris generated by the texturing process can change gas-dynamic properties of the fluid flow in the texturing apparatus and/or the temperature of the texturing apparatus. When the clogging is controlled and/or reduced/and/or eliminated, the gas dynamic properties of the fluid in the texturing apparatus and the temperature of the texturing apparatus are more stable.

In another embodiment, the texturing system comprises a controller configured to control the cleaning means such that the cleaning means clean the openings.

This embodiment can be advantageous, because it can provide for automation of the cleaning process.

In another embodiment, the texturing system comprises: a yarn heating element for heating of the artificial turf yarn before its texturing in the texturing apparatus; a third temperature sensor configured to sense a temperature of the yarn heating element; and a third controller coupled with the third temperature sensor, wherein the third controller is configured to control the yarn heating element such that the actual temperature of the yarn heating element is held at a third desired temperature.

This embodiment can be advantageous, because it can provide for an advanced texturing process control and repeatability. Utilization of the yarn heating element can provide for an advanced control of the temperature of the yarn in the temperature process, since the yarn is heated not only in the texturing apparatus but by the preheating element as well.

In another embodiment, the third desired temperature is higher than the first desired temperature.

This embodiment can be advantageous, because such a selection of the third desired temperature can compensate for cooling of the yarn during its transportation from the yarn heating element to the texturing apparatus.

In another embodiment, the texturing apparatus comprises an inlet port (injector jet) for receiving the artificial turf yarn, wherein the third desired temperature is selected such that cooling of the artificial turf yarn during its transportation from the yarn heating element to the inlet port is compensated in order to provide at the inlet port the artificial turf yarn having the first desired temperature. The third desired temperature can be 0.3-2 degrees Celsius higher than the first desired temperature, preferably 0.3-1 degree Celsius higher than the first desired temperature, more preferably 0.3-0.5 degree Celsius higher than the first desired temperature.

In another embodiment, the artificial turf yarn comprises a polymer blend of polymers, wherein the first desired temperature is determined using differential scanning calorimetry, DSC, data of a sample of the polymer blend.

Utilization of the DSC data may be advantageous, because it may provide for a melting temperature of the polymer (or its particular polymorphic modification) in the polymer blend. As discussed further in greater detail, the texturing (curling) of the monofilament yarn may be performed within the temperature range, in which at least a portion of a crystalline fraction (or of a polymorphic modification) of at least one of the polymers of the polymer blend remains in a solid state. Thus the knowledge of the melting temperatures determined using DSC data may provide for the temperature range that may be optimal for the texturing (curling) process.

Determination of an optimal temperature range or an optimal temperature of the texturing (curling) process as described above and/or further in the text can be of particular advantage for manufacturing of a (stretched and) textured monofilament yarn with delayed and/or reduced texture reversion, when the (stretched and) textured monofilament yarn is used as a textured artificial yarn in an artificial turf.

In another embodiment, the first desired temperature is determined such that a portion of a crystalline fraction of the polymer blend is in a solid state when the gas-dynamic texturing is performed and another portion of the crystalline fraction of the polymer blend is in a molten state when the gas-dynamic texturing is performed.

This embodiment may be advantageous because it may provide for an optimal texturing process temperature, wherein at least a portion of each of the polymers (or their polymorphic modifications) of the polymer blend is in a molten state. The portion of the crystalline fraction that is molten can be more than 10% (preferably 25%) by weight of the entire crystalline fraction. The portion of the crystalline fraction that remains solid can be more than 10% (preferably 25%) by weight of the entire crystalline fraction. The texturing process of executed in accordance with the specified above portions of the molten and solid crystalline fractions results in manufacturing of the (stretched and) textured monofilament yarn with the aforementioned delayed and/or reduced texture reversion.

In another aspect the invention provides for a system for manufacturing of an artificial turf. The system comprises a texturing system for gas-dynamic texturing of an artificial turf yarn as described above and/or further in the text; and a system for attaching of the textured artificial turf yarn to a backing of the artificial turf.

Such a system can be advantageous because it comprises the texturing system with advanced process control, which can provide for a manufacturing of the artificial turf with advanced quality, in particular with the aforementioned delayed and/or reduced texture reversion of the (stretched and) textured monofilament yarn.

In another aspect the invention provides for a method of manufacturing a textured artificial turf yarn using the texturing system for gas-dynamic texturing of the artificial turf yarn. The method comprises texturing the artificial turf yarn using the texturing system to provide the textured artificial turf yarn, wherein the first controller of the texturing system is configured to control the heating device such that the temperature of the texturing apparatus is held at the first desired temperature.

This method can be advantageous because it employs the texturing system with advanced process control, as a result thereof the method can have an improved process stability and the textured artificial turf yarn can have advanced properties such as the aforementioned delayed and/or reduced texture reversion of the (stretched and) monofilament yarn.

In another embodiment, the method further comprises: providing the artificial turf yarn (e.g. a monofilament yarn), wherein the artificial turf yarn comprises a polymer blend (mixture) of polymers; receiving differential scanning calorimetry (DSC) data of a sample of the polymer blend; determining one or more melting temperatures of the artificial turf yarn using the DSC data; determining the first desired temperature of the texturing process using the one or more melting temperatures The artificial turf yarn may have, for instance, a width of 1-1.1 mm and a thickness of 0.09-0.11 mm. The artificial turf yarn weight may typically reach 50-3000 dtex. The DSC data can be measured by using a DSC system.

In another embodiment, the first desired temperature of the texturing process is determined such that a crystalline fraction of one of the polymers is completely or almost completely in a solid state in a process of the texturing of the artificial turf yarn and a crystalline fraction of another one of the polymers is completely or almost completely in a molten state in the process of the texturing of the artificial turf yarn.

This embodiment may be advantageous because it may provide for a more robust process temperature, wherein at least one crystalline fraction of the respective polymer remains completely or almost completely in a solid state during the texturing (curling) process. Selecting the texturing process temperature as specified in this embodiment may provide for an improved stability and repeatability of the texturing process, because in the texturing process the crystalline fraction of one of the polymers is completely in a solid state and the crystalline fraction of the other one of the polymers is completely in a molten state. In addition, selecting the texturing process temperature as specified in this embodiment can provide for manufacturing of the (stretched and) textured monofilament yarn with the aforementioned delayed and/or reduced texture reversion.

In another embodiment the one or more melting temperatures is two or more melting temperatures, wherein the first desired temperature is determined within a temperature range or the first desired temperature is determined as a range within the temperature range, wherein the temperature range has an upper boundary temperature being less or equal to one of the melting temperatures, wherein the temperature range has a lower boundary temperature being greater or equal to another one of the melting temperatures.

This embodiment may be advantageous because it may provide for a simple and straightforward definition of the optimal texturing process temperature, which can provide for provide for manufacturing of the (stretched and) textured monofilament yarn with the aforementioned delayed and/or reduced texture reversion.

In another embodiment, the upper boundary temperature is no more than a predetermined percentage larger than the lower boundary temperature in degrees Celsius, wherein the predetermined percentage is any one of the following: 5%, 10%, or 15%.

This embodiment may be advantageous because it may provide for a simple definition of the optimal process window, because only one melting temperature has to be determined using the DSC data (e.g., heat flow versus temperature curve). The only one melting temperature can be determined using the first registered peak of the curve, when the curve is measured by increasing the temperature. In addition, this embodiment may be advantageous because the heating of the artificial turf yarn in the step of the texturing (curling) of the monofilament yarn may be reduced to a minimum, thereby providing for an energy-efficient process.

In another embodiment the other one of the melting temperatures is the lowest of the one or more melting temperatures. The crystalline melting temperature used in this embodiment can be used as the lower boundary temperature.

In another embodiment, each of the melting temperatures is a melting temperature of the respective polymer. As mentioned above and/or further in the text, the polymers of the blend can be numbered. This is made merely for clarity purposes. One of the polymers of the polymer blend/mixture is called the first polymer, another one of the polymers of the polymer blend/mixture is called the second polymer, yet another one of the polymers of the polymer blend/mixture is called the third polymer, etc.

In another embodiment, the melting temperature of the respective polymer is a minimum temperature at which only a portion of a crystalline fraction of the respective polymer is in a molten state. The portion of the crystalline fraction of the polymer can be defined in a range of 10%-90% (preferably 25%-75%) by weight of a crystalline fraction of the polymer.

In another embodiment, the DSC data comprises a heat flow curve versus temperature, wherein the crystalline temperature of the respective polymer is a temperature at which a peak of a heat flow curve corresponding to a melting of a crystalline fraction of the respective polymer has its maximum.

This embodiment may be advantageous because it can provide for an effective approach for determining the melting temperatures.

In another embodiment, wherein at least one of the polymers has polymorphism, wherein some of the melting temperatures is a melting temperature of a respective polymorphic modification of the polymer having polymorphism.

In another embodiment the polymer blend comprises first portions each having the respective polymorphic modification, wherein the melting temperature of the respective polymorphic modification is a minimum temperature at which only a portion of the first portion having the respective polymorphic modification is in a molten state. The portion of the first portion can be defined in a range of 10%-90% (preferably 25%-75%) by weight of the first portion. The texturing process of executed in accordance with the specified above portions of the molten and solid crystalline fractions results in manufacturing of the (stretched and) textured monofilament yarn with the aforementioned delayed and/or reduced texture reversion.

In another embodiment the DSC data comprises a heat flow curve versus temperature, wherein the crystalline temperature of the respective polymorphic modification is a temperature at which a peak of the heat flow curve corresponding to a melting of the respective polymorphic modification has its maximum.

This embodiment may be advantageous because it can provide for an effective approach for determination of the melting temperatures.

In another embodiment, the DSC data comprises a curve of a heat flow versus temperature in a temperature range, wherein the curve has a base line, wherein the curve coincides with the base line at a lower boundary temperature of the temperature range and at an upper boundary temperature of the temperature range, wherein the upper boundary temperature and the lower boundary temperature are different temperatures, wherein the determined desired temperature complies with the following constraint: a ratio of an integral value and an overall integral value is within a predefined range, wherein the integral value is equal to an integral of a difference of the curve and the base line from the lower boundary temperature to the determined desired temperature, wherein the overall integral value is equal to an integral of the difference of the curve and the base line from the lower boundary temperature to the upper boundary temperature. The predefined range can be 0.05-0.15, preferably 0.09-0.11.

In another embodiment at least two of the polymers are different types of polyethylene.

This embodiment may be advantageous because polyethylene may have superior properties for manufacturing of the textured yarn in comparison with other polymers. Particularly, linear polyethylene (e.g. LLDPE or/and HDPE) offers a wide range of physical material properties, covering the technical requirements of artificial turf yarn. The density of linear polyethylene can be widely modified by co-monomers. The molecular weight distribution can be controlled with catalysts and by polymerization process management. Blending different types of polyethylene broadens the variability further. In particular, LLDPE is blended, i. e. mixed, with compatible material, such as VLDPE and/or HDPE with densities different from LLDPE. It may also be possible to blend different types of LLDPE.

Utilization of polymer blends comprising different types of polyethylene may provide for a balance between stability and softness of the textured yarn. Stability means in this context stiffness, wear resistance, hardness, resilience, etc., whereas softness means flexibility, elasticity, smoothness, etc. Blending different materials each with the required stability or softness results in the properties providing the required balance between stability and softness.

In another embodiment the method further comprises raising the temperature of the monofilament yarn to a temperature within the temperature range (of the texturing process) using one or more godets (or the yarn heating element).

This embodiment may be advantageous because it may provide for an improved process control, since the artificial turf yarn is preheated in order to provide the artificial turf yarn entering the texturing apparatus, such that the texturing apparatus and the artificial turf yarn have the same temperature or substantial similar temperatures.

In another embodiment the sample for collecting the DSC data is taken from the polymer blend.

This embodiment may be advantageous because it may provide for an effective determination of the temperature range within which the texturing (curling) of the artificial turf yarn is performed.

In another embodiment the sample for collecting the DSC data is a sample of the artificial turf yarn, wherein the artificial turf yarn can be a monofilament yarn.

This embodiment may be advantageous because it may provide for an effective determination of the temperature range within which the texturing (curling) of the artificial turf yarn is performed. For instance, the artificial turf yarns can be manufactured using different methods. Executing DSC on different samples can enable selection of an appropriate artificial turf yarn.

In another embodiment the method further comprises drawing (stretching) the artificial turf yarn, e.g. to a factor of 4-6.5.

This embodiment may be advantageous because it may provide for an increase in crystallinity of the artificial turf yarn (e.g. an increase in crystallinity of at least one of the polymers of the polymer blend used for the manufacturing of the artificial turf yarn). In the other words, the size of crystalline portions of the artificial turf yarn (or at least one of the polymers of the polymer blend) is increased relative to the size of amorphous portions of the artificial turf yarn. As a result the artificial turf yarn or at least of the polymers of the polymer blend become more rigid. The stretching of the artificial turf yarn can further cause reshaping of fragments (e.g. beads) of one of the polymers of the polymer blend used for the manufacturing of the monofilament yarn such that they have thread like regions, which can make impossible delamination of different polymers in the monofilament yarn from each other, in particular when immiscible polymers are used in the polymer blend. This embodiment may also be advantageous, because the drawing (stretching) process of the monofilament yarn can give rise to polymorphism, i. e. crystallographic unit cell modification. For instance the drawing process can result in forming triclinic crystal modification of polyethylene in addition to orthorhombic crystal modification of polyethylene formed after extruding and cooling. In addition, this embodiment may also be advantageous, because drawing (stretching) of the monofilament yarn results in manufacturing of the stretched and textured monofilament yarn with the aforementioned delayed and/or reduced texture reversion.

This drawing (stretching) of the artificial turf yarn causes the yarn to become longer and in this process the fragments of one of the polymers of the polymer blend (e.g. beads) are stretched and elongated. Depending upon the amount of stretching the fragments of one of the polymers (e.g. beads) of the polymer blend are elongated more. This effect can contribute for manufacturing of the stretched and textured monofilament yarn with the aforementioned delayed and/or reduced texture reversion.

In another embodiment the providing of the artificial turf yarn comprises extruding the polymer blend into the artificial turf yarn.

This embodiment may be advantageous, because it may provide for manufacturing of the artificial turf yarn out of a broad spectrum of polymers including immiscible polymers.

In another embodiment the method further comprises creating the polymer blend (mixture), wherein the polymer blend is at least a three-phase system, wherein the polymer blend comprises a first polymer, a second polymer, and a compatibilizer, wherein the first polymer and the second polymer are immiscible, wherein the first polymer forms polymer beads surrounded by the compatibilizer within the second polymer.

This embodiment may be advantageous because utilization of this polymer blend for the manufacturing of the stretched and textured monofilament yarn may result in the textured monofilament yarn with the aforementioned delayed and/or reduced texture reversion because of the following reasons. For instance, the first polymer could be polyamide and the second polymer could be polyethylene. Stretching the polyamide will cause an increase in the crystalline regions making the polyamide stiffer. This is also true for other semi-crystalline plastic polymers. In addition, utilization of the compatibilizer may enable utilization of a broader spectrum of polymers for manufacturing of the monofilament yarn such that the properties of the artificial turf fiber can be tailored. As it is mentioned above different polymers of the polymer blend can provide for different properties of the textured yarn. One polymer can provide for the stability (e.g. delayed and/or reduced texture reversion) and/or the resilience (e.g. the ability to spring back after being stepped or pressed down), while another polymer can provide for the softness (e.g. the softer or a grass-like feel). Moreover due to compatibilizer, the second polymer and any immiscible polymers may not delaminate from each other. The thread-like regions can be embedded within the second polymer. It is therefore impossible for them to delaminate. As a result thereof, the texture reversion is delayed and/or reduced. Moreover, the thread-like regions may be concentrated in a central region of the monofilament during the extrusion process. This may lead to a concentration of the more rigid material in the center of the monofilament yarn and a larger amount of softer plastic on the exterior or outer region of the monofilament yarn. This may further provide for the delaying and/or reduction of the texture reversion in the artificial turf yarn/fiber, which in addition may have with more grass-like properties.

A further advantage may be that the artificial turf fibers made of the textured (curled) monofilament yarn have improved long term elasticity, which in its own turn may result in the reduction and/or delaying of the texture reversion. As a consequence, the maintenance of the artificial turf may be reduced, this means less brushing of the fibers because they more naturally regain their shape and stand up after mechanical use.

In another embodiment the creating of the polymer blend (mixture) comprises the steps of: forming a first blend (mixture) by mixing the first polymer with the compatibilizer; heating the first blend (mixture); extruding the first heated blend (mixture); granulating the extruded first blend (mixture); mixing the granulated first blend (mixture) with the second polymer; and heating the granulated first blend (mixture) with the second polymer to form the polymer blend (mixture). This particular method of creating the polymer mixture may be advantageous because it enables very precise control over how the first polymer and compatibilizer are distributed within the second polymer. For instance the size or shape of the extruded first mixture may determine the size of the polymer beads in the polymer mixture.

This embodiment may be advantageous, because a so called single-screw extrusion method may be used. As an alternative to this, the polymer blend may also be created by putting all of the components that make it up together at once. For instance the first polymer, the second polymer and the compatibilizer could be all added together at the same time. Other ingredients such as additional polymers or other additives could also be put together at the same time. The amount of mixing of the polymer blend could then be increased for instance by using a twin-screw feed for the extrusion. In this case the desired distribution of the polymer beads can be achieved by using the proper rate or amount of mixing.

In another embodiment the polymer blend (mixture) is at least a four phase system, wherein the polymer blend comprises at least a third polymer, wherein the third polymer is immiscible with the second polymer, wherein the third polymer further forms the polymer beads surrounded by the compatibilizer within the second polymer.

This embodiment may be advantageous because it may enable utilization of an even broader spectrum of polymers for manufacturing of the monofilament yarn. As it is mentioned above different polymers of the polymer blend can provide for different properties of the textured yarn. One polymer can provide for the stability, while another polymer can provide for the softness. This particular embodiment can provide for combining in a final product properties of at least three polymers. Utilization of said broader spectrum of polymers for manufacturing of the monofilament yarn can contribute for manufacturing of the stretched and textured monofilament yarn with the aforementioned delayed and/or reduced texture reversion.

In another embodiment the creating of the polymer blend (mixture) comprises the steps of: forming a first blend by mixing the first polymer and the third polymer with the compatibilizer; heating the first blend (mixture); extruding the first heated blend (mixture); granulating the extruded first blend (mixture); mixing the first blend with the second polymer; and heating the mixed first blend with the second polymer to form the polymer blend (mixture).

This embodiment may be advantageous because it may provide for an effective procedure for manufacturing of the polymer blend comprising multiple polymers. As an alternative the first polymer could be used to make a granulate with the compatibilizer separately from making the third polymer with the same or a different compatibilizer. The granulates could then be mixed with the second polymer to make the polymer mixture. As another alternative to this the polymer mixture could be made by adding the first polymer, a second polymer, the third polymer and the compatibilizer all together at the same time and then mixing them more vigorously. For instance a two-screw feed could be used for the extruder.

In another aspect the invention provides for a textured (curled) artificial turf yarn manufactured as described above.

In another aspect the invention provides for a method of manufacturing an artificial turf, wherein the method comprises manufacturing the textured artificial turf yarn as described above; tufting the textured artificial turf yarn into a backing of the artificial turf. The artificial turf backing may for instance be a textile or other flat structure which is able to have fibers tufted into it. The textured artificial turf yarn may also have properties or features which are provided for by any of the aforementioned method steps.

In another aspect the invention provides for an artificial turf manufactured according to the method for manufacturing of the artificial turf according to the aforementioned embodiment.

In another aspect the invention provides for a method of delaying and reducing texture reversion of a textured artificial turf yarn, characterized by using a stretched and textured monofilament yarn as the textured artificial turf yarn. The stretched and textured monofilament yarn comprises a polymer mixture (blend), wherein the polymer mixture is at least a three-phase system, wherein the polymer mixture comprises a first polymer, a second polymer, and a compatibilizer, wherein the first polymer and the second polymer are immiscible, wherein the first polymer forms polymer beads surrounded by the compatibilizer within the second polymer. The polymer mixture (blend) can be prepared as described above and/or further in the text. The monofilament yarn can be textured as described above and/or further in the text. The monofilament yarn can be stretched/drawn as described above and/or further in the text. The stretched and textured monofilament yarn can be integrated into an artificial turf backing to form an artificial turf as described above and/or further in the text. The stretched and textured monofilament yarn integrated into the artificial turf backing can be subjected to a mechanical and/or weathering stress as described above and/or further in the text.

The advantage of the method of delaying and reducing texture reversion of the textured artificial yarn can be proved as follows. A test sample of the stretched and textured artificial yarn is prepared according to the method described herein, wherein the yarn comprises the polymer mixture comprises the first polymer, the second polymer, and a compatibilizer. A reference sample of the stretched and textured artificial yarn is prepared according to the method described herein, wherein the yarn of the reference sample consists of only the first polymer or the second polymer. Alternatively the yarn of the reference sample can consist of a pair of miscible polymers, wherein one of the polymers is either the first or the second polymer used for the manufacturing of the test sample. In additional, the texturing process of the yarn of the reference sample is optimized such that the yarn of the reference sample has the same or substantially similar degree of shrinkage (A0) as the yarn of the test sample. Preferably both of the samples have the same or substantially similar length and/or cross-section. The length of the test and the reference sample are measured before and after the samples are subjected to one of the following: the accelerated mechanical test, the accelerated weathering test, the natural mechanical test, the natural weathering test. The examples of these tests are given above. The reference sample has a higher A1 value than the test sample after both of the samples are subjected to one or more of the aforementioned tests.

This method can be advantageous because it can provide for the textured artificial turf yarn with the aforementioned delayed and/or reduced texture reversion. As a result thereof lifetime and/or durability of the artificial turf may be increased.

In another embodiment, the first polymer comprises (or consists of) polyamide (PA) and the second polymer comprises (or consists of) polyethylene (PE). The first polymer may comprise at least 90 weight percent of PA. The second polymer can comprise at least 90 weight percent of PE. The polymer mixture can comprise at least 30 weight percent of PE and/or at least 30 weight percent of PA.

This embodiment can be advantageous, because it can provide for the textured artificial turf yarn with the aforementioned delayed and/or reduced texture reversion.

In another embodiment, the first polymer comprises (or consists of) polyester and the second polymer comprises (or consists of) PE. The first polymer may comprise at least 90 weight percent of polyester. The second polymer can comprise at least 90 weight percent of PE. The polymer mixture can comprise at least 30 weight percent of PE and/or at least 30 weight percent of polyester.

This embodiment can be advantageous, because it can provide for the textured artificial turf yarn with the aforementioned delayed and/or reduced texture reversion.

In another embodiment, the first polymer comprises (or consists of) polyester and the second polymer comprises (or consists of) polypropylene (PP). The first polymer may comprise at least 90 weight percent of polyester. The second polymer can comprise at least 90 weight percent of PP. The polymer mixture can comprise at least 30 weight percent of PP and/or at least 30 weight percent of polyester.

This embodiment can be advantageous, because it can provide for the textured artificial turf yarn with the aforementioned delayed and/or reduced texture reversion.

In another embodiment, the first polymer comprises (or consists of) PA and the second polymer comprises (consists of) PP. The first polymer may comprise at least 90 weight percent of PA. The second polymer can comprise at least 90 weight percent of PP. The polymer mixture can comprise at least 30 weight percent of PP and/or at least 30 weight percent of PA.

This embodiment can be advantageous, because it can provide for the textured artificial turf yarn with the aforementioned delayed and/or reduced texture reversion.

In another embodiment, the compatiblizer comprises any one of the following: a maleic acid grafted on polyethylene or polyamide; a maleic anhydride grafted on free radical initiated graft copolymer of polyethylene, SEBS, EVA, EPD, or polyproplyene with an unsaturated acid or its anhydride such as maleic acid, glycidyl methacrylate, ricinoloxazoline maleinate; a graft copolymer of SEBS with glycidyl methacrylate, a graft copolymer of EVA with mercaptoacetic acid and maleic anhydride; a graft copolymer of EPDM with maleic anhydride; a graft copolymer of polypropylene with maleic anhydride; a polyolefin-graft-polyamidepolyethylene or polyamide; and a polyacrylic acid type compatibilizer. The SEBS is styrene-ethylene-butylene-styrene. The EVA is ethylene-vinyl acetate. The EPD is polyamide-6 polymer. The EPDM is ethylene propylene diene monomer (M-class) rubber. The polymer mixture may comprise at least 10 weight percent of the compatibilizer.

This embodiment may be advantageous, because it can provide for the polymer mixture which utilization results in manufacturing of the textured artificial turf yarn with the aforementioned delayed and/or reduced texture reversion.

In another embodiment, the polymer mixture is at least a four-phase system as described above and/or further in the text. This mixture can be prepared as described above and further in the text. The third polymer in this mixture may be any one of the following: polyethylene terephthalate (PET) and polybutylene terephthalate (PBT). The polymer mixture may comprise at least 20 weight percent of the third polymer. Utilization of these polymers and/or the aforementioned concentration of the third polymer may facilitate delaying and/or reducing texture reversion of the textured artificial turf yarn.

In another embodiment, the method comprises the following steps: extruding the polymer mixture into a monofilament yarn; quenching the monofilament yarn; heating the quenched monofilament yarn; stretching the heated monofilament yarn to deform the polymer beads into threadlike regions and to form the heated monofilament yarn into a stretched monofilament yarn; and texturing the stretched monofilament yarn to form the textured and stretched monofilament yarn.

This embodiment may be advantageous, because the irreversible changing of the shape of the polymer beads into threadlike regions can facilitate delaying and/or reducing texture reversion of the textured artificial turf yarn.

In another embodiment, the polymer bead comprises crystalline portions and amorphous portions, wherein stretching the polymer beads into threadlike regions causes an increase in the size of the crystalline portions relative to the amorphous portions.

This embodiment may be advantageous because the increase in the size of the crystalline portions relative to the amorphous portions can facilitate delaying and/or reducing texture reversion of the textured artificial turf yarn.

BRIEF DESCRIPTION OF THE DRAWINGS

In the following embodiments of the invention are explained in greater detail, by way of example only, making reference to the drawings in which.

DETAILED DESCRIPTION

Like numbered elements in these figures are either equivalent elements or perform the same function. Elements which have been discussed previously will not necessarily be discussed in later figures if the function is equivalent.

Figure 1:
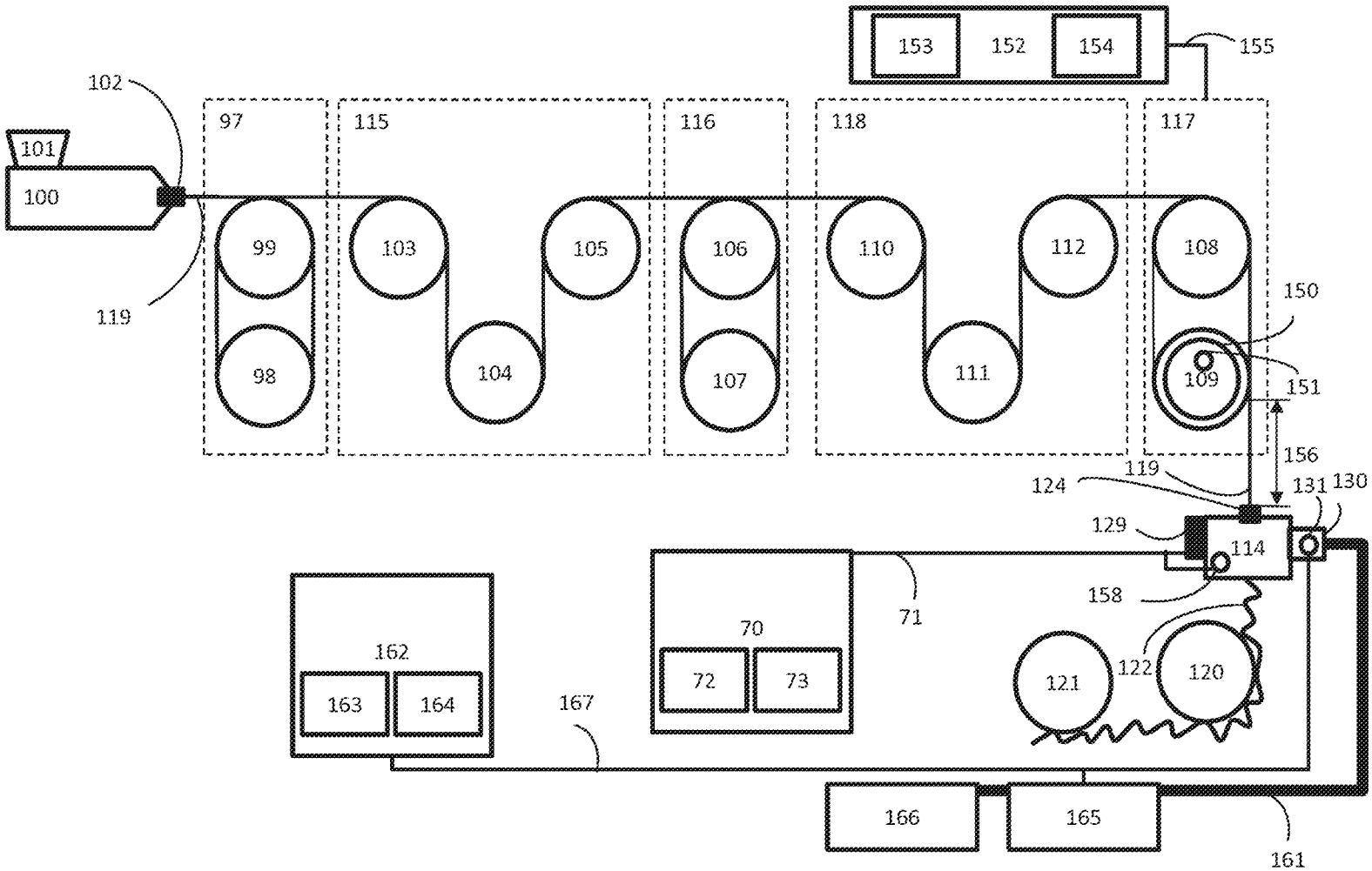
FIG. 1 illustrates an example of a system for manufacturing of a textured (curled) artificial turf yarn.

FIG. 1 illustrates an example system of manufacturing of a textured (curled) monofilament yarn 122 (or textured artificial turf yarn). The system comprises: an extruder 100 (e.g. a screw-extruder) and a texturing (curling) system. The system can further comprise one or more drawing devices 115, 118, one or more thermosetting (or heating) devices (e.g. godets, ovens) 117, one or more cooling devices (e.g. godets, bathes with cooling liquid) 116, 120, 97, and one or more rollers 121.

The extruder 100 comprises at least one hopper 101 for feeding components of a monofilament yarn (e.g. a blend of polymers) into the extruder and one outlet 102 for the monofilament yarn. The outlet 102 can be implemented as a wide slot nozzle or a spinneret. A polymer melt formed in a chamber of the extruder is pressed through the outlet 102 to form a monofilament yarn of a specific shape. A fragment of the wide slot nozzle or the spinneret is depicted in FIG. 2.

Figure 2:
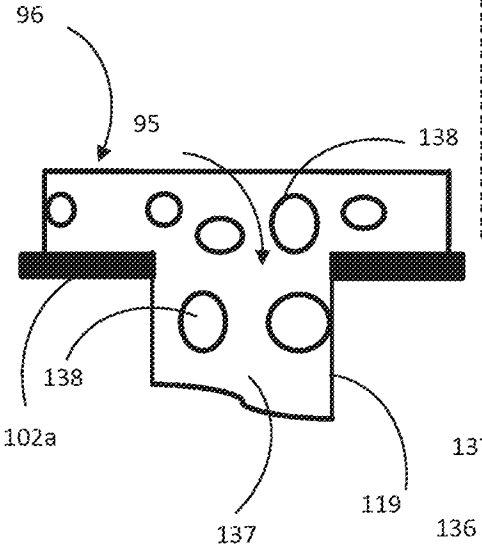
FIG. 2. Illustrates an example plate for extruding of a monofilament yarn

FIG. 2 illustrates the extrusion of the polymer mixture into a monofilament. Shown is an amount of polymer blend 96. Within the polymer blend 96 there is a large number of portions 138 of a first polymer of the polymer blend 96 being at least partially embedded in a second polymer 137 of the polymer blend 96. A screw, piston or other device of the extruder 100 is used to force the polymer mixture 96 through a hole 95 in a plate 102*a*. This causes the polymer blend 96 to be extruded into a monofilament yarn 119. The monofilament yarn 119 is shown as containing fragments 138 of the first polymer of the polymer blend 96 also. The both of the polymers of are extruded together.

In some examples the polymer blend can have different compositions. Within the polymer blend 96 there is a large number of polymer beads 138. The polymer beads 138 may be made of one or more polymers that is not miscible with the second polymer 137 and is also separated from the second polymer 137 by a compatibilizer. A screw, piston or other device is used to force the polymer blend 96 through a hole 95 in a plate 102*a*. This causes the polymer blend 96 to be extruded into a monofilament yarn 119. The monofilament yarn 119 is shown as containing polymer beads 138 also. The second polymer 137 and the polymer beads 138 are extruded together. In some examples the second polymer 137 will be less viscous than the polymer beads 138 and the polymer beads 408 will tend to concentrate in the center of the monofilament yarn 119. This may lead to desirable properties for the final artificial turf fiber as this may lead to a concentration of the thread-like regions in the core region of the monofilament yarn 119.

The monofilament yarn can be cooled down after the extrusion using the cooling device 97. When the cooling device is implemented as a godet, it can comprise two rollers 99 and 98 for winding the monofilament yarn 119. The cooling process can be implementing by maintaining a temperature of the rollers 99 and 98 within the specified range and/or by air cooling and/or by water cooling. A temperature of water (or air) can be kept within a specified range as well. Alternatively the cooling device can be a bath with a cooling liquid (e.g. water) in which the monofilament yarn is cooled. The monofilament yarn is cooled down using the cooling device 97 to a temperature where crystallization can take place. In the crystallization process the crystallites are forming to a percentage, which depends on the cooling rate. The higher the cooling rate, the less is the crystallinity and vice versa.

The monofilament yarn can be further drawn using the drawing device 115. The drawing device can comprise three rollers 104, 103, 105. The drawing ratio is defined as the ratio of linear speeds of a pair of rollers 103 and 104 (or 104 and 105). The drawing device 115 can be operable for heating the monofilament yarn 119 during or before the drawing process. This can be implemented by heating one or more the rollers in order to keep their temperature within a predetermined temperature range and/or by air heating, wherein the hot air has a temperature within a predetermined temperature range. The elongation of the monofilament yarn in the drawing device can force the macromolecules of the monofilament yarn to parallelize. This results in a higher degree of crystallinity and increased tensile strength, compared with undrawn monofilament yarn. These effects may facilitate manufacturing of the textured artificial turf yarn with delayed and/or reduced texture reversion.

Figure 3:
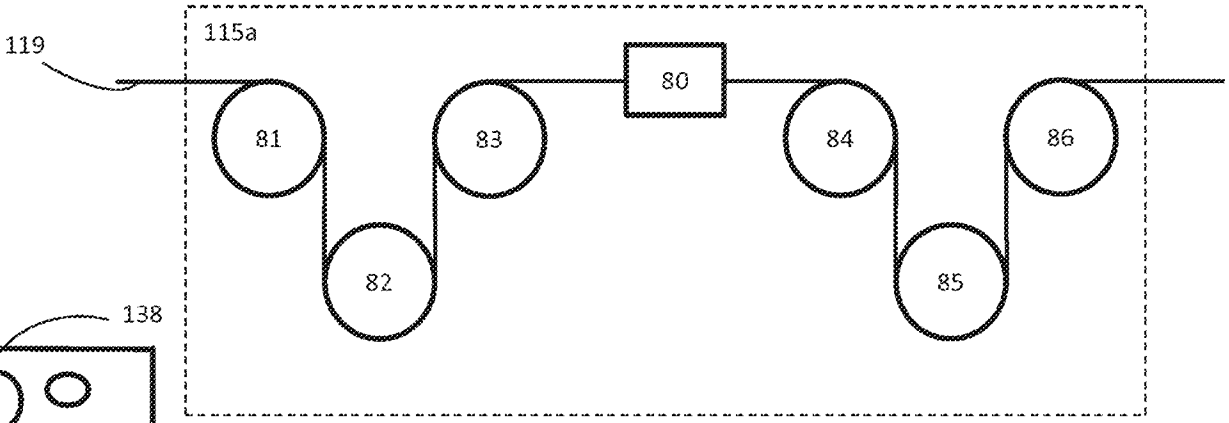
FIG. 3 illustrates an example drawing device.

FIG. 3 depicts an alternative implementation 115*a* of any of the drawing devices mentioned herein (e.g. the drawing device 115 or 118). The drawing device comprises one or more feeding rollers 81-83, an oven 80, and one or more receiving rollers 84-86. The one or more feeding rollers are configured to feed the monofilament yarn 119 into the oven. The one or more receiving rollers are configured to receive the monofilament yarn from the oven. The oven is configured to heat the monofilament yarn. The drawing ratio is determined by a ratio of the linear speeds of the feeding roller 83 being the last roller before the oven and the receiving roller 84 being the first after oven. The thermosetting process (drawing process) is performed in the oven 80, in which the monofilament yarn in stretched and heated simultaneously.

Figure 5:
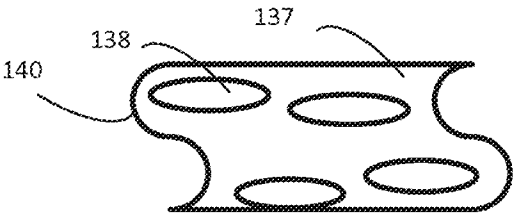
FIG. 5 illustrates an example cross-section of a monofilament yarn.
Figure 4:
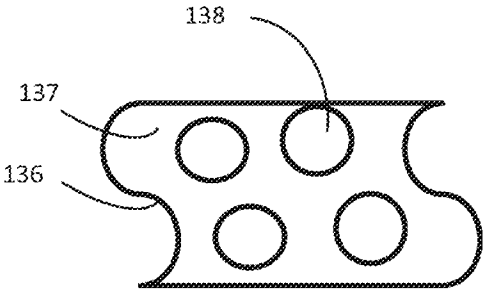
FIG. 4 illustrates an example cross-section of a monofilament yarn.

FIG. 4 depicts a not to scale cross-section of a segment the monofilament yarn 136 before its processing in the drawing device 115, whereas FIG. 5 depicts a not to scale cross-section of a segment of the monofilament yarn 140 after its processing in the drawing device 115. Before the drawing process the fragments of the first polymer 138 can have an arbitrary shape, e.g. a shape of beads. The fragments of the first polymer are at least partially incorporated in the second polymer 137. After the drawing process the fragments of the first polymer 138 have elongated shape in comparison to the fragments of the first polymer 128 before the drawing process. The fragments of the first polymer 138 may be elongated much more than depicted on FIG. 4. For instance, they may form threadlike regions.

The monofilament yarn can be further cooled using the cooling device 116. The cooling device, when implemented as a cooling godet can have rollers 106 and 107. The cooling device can be built and/or function in the same way as the cooling device 97. Afterwards the monofilament yarn can be further drawn using the drawing device 118 having rollers 110, 111, and 112. The drawing device 118 can be built and/or function in the same way as the drawing device 115.

The monofilament yarn can be further heated using one or more heating devices or elements (e.g. device 117). The heating device comprises a heater (or a heating element) and a temperature sensor for sensing a temperature of the heater (or the heating element). The heater can be implemented as an electrical resistance heater. The heating device is controlled by a controller (e.g. controller 152) such that the temperature of the heater is kept at a desired temperature (this temperature is mentioned herein as the third desired temperature as well). The controller comprises a computer processor 153 and memory 154 comprising instructions executable by the computer processor. The controller is communicatively coupled to the heating device and the temperature sensor configured to sense a temperature of the heating device. The communicative coupling can be implemented via a computer network 155. The controller is operable to hold an actual temperature of the heating device at the third desired temperature. The third desired temperature can be selected such that the yarn cooled during a transportation from the heater to the texturing apparatus (e.g. distance 156) has a temperature of the texturing process (this temperature is mentioned herein as the first desired temperature as well) when it enters the texturing apparatus 114, or its inlet port 124 for receiving the yarn. In this case the third desired temperature is higher than the temperature of the texturing process. The execution of the computer instructions by the computer processor 153 causes the controller to hold the process temperature at the desired temperature. The control of the process temperature can be implemented as follows. The controller reads out the temperature of the heater sensed by the temperature sensor. The temperature of the heater is used as a feedback signal for setting the temperature of the heating device 117 in order to provide the heating of the monofilament yarn to the third desired temperature. The functioning of this feedback loop can be implemented using a proportional-integral-derivative algorithm. The third desired temperature can be specified as a temperature range. In this case the holding of the actual temperature at the desired temperature comprises keeping the actual temperature within the specified range, in particular the actual temperature is kept as close as possible to a middle temperature of the temperature range. The middle temperature is equal to an average of a lower boundary of the temperature range and an upper boundary of the chosen temperature range.

The heating device 117, when implemented as a godet, comprises a pair of rollers 108 and 109. The heating of the monofilament yarn can be made by keeping a temperature of the rollers within a predetermined temperature range and/or by hot air having a temperature within a predetermined temperature range. For instance the roller 109 can be equipped with a heater 150 and a temperature sensor 151 both communicatively coupled to the controller 152.

A controller 70 is configured to control a temperature of the texturing apparatus 114. The controller 70 comprises a computer processor 72 and memory 73 comprising instructions executable by the computer processor. The controller is communicatively coupled to the temperature sensor 158 configured to sense a temperature of the texturing apparatus 114, and a heating device, 129. The heating device can be configured to heat the texturing device through physical contact between the texturing device and the heating device or by electromagnetic induction. The physical contact can be a direct physical contact or a contact in which a thermally conductive paste is used between the heating device 129 and the texturing apparatus 114. At least a portion of the texturing device can be placed inside or in the proximity of the electromagnet of the heating device configured to heat the texturing device by electromagnetic induction. The heating device can be implemented as an electrical resistance heater. Further heating devices and temperature sensors which can be operated by the controller 70 (or other controllers) are depicted on FIG. 6. The communicative coupling can be implemented via a computer network 71. The controller is operable to hold an actual temperature of the texturing apparatus at a desired temperature which can be the temperature required for the texturing process (this desired temperature is mentioned as the first desired temperature herein as well). The desired temperature can be specified as a temperature range. In this case the holding of the actual temperature at the desired temperature comprises keeping the actual temperature within the specified range, in particular the actual temperature is kept as close as possible to a middle temperature of the temperature range. The middle temperature is equal to an average of a lower boundary of the temperature range and an upper boundary of the chosen temperature range. The execution of the computer instructions by the computer processor 72 causes the controller to hold the texturing apparatus temperature at the desired temperature. The control of the texturing apparatus temperature can be implemented as follows. The controller reads out the temperature of the texturing apparatus sensed by the temperature sensor 158. The temperature of the texturing apparatus is used as a feedback signal for setting the temperature of the heating device 129 in order to provide the heating of the texturing apparatus to the desired temperature. The functioning of this feedback loop can be implemented using a proportional-integral-derivative algorithm.

The texturing apparatus 114 has an inlet 130 for a fluid under pressure used for the texturing process. The fluid can be hot air, i.e. air above ambient temperature. The hot fluid under pressure can be produced by a compressor 166 and a heating element 165 for heating the fluid. The heating element can be implemented as an electrical resistance heater. A temperature of the fluid entering the texturing apparatus can be controlled by controller 162 comprising a computer processor 163 and a memory 164 storing processor executable instructions. The controller 162 is communicatively coupled to the heating element 165 and to a temperature sensor 131 configured to sense a temperature of the fluid in the texturing apparatus (or in the inlet 130). The communicative coupling can be implemented via a computer network 167. The controller is operable to hold an actual temperature of the fluid at a desired temperature which can be the temperature required for the texturing process (this desired temperature is mentioned as the second desired temperature herein as well). The desired temperature can be specified as a temperature range. In this case the holding of the actual temperature at the desired temperature comprises keeping the actual temperature within the specified range, in particular the actual temperature is kept as close as possible to a middle temperature of the temperature range. The middle temperature is equal to an average of a lower boundary of the temperature range and an upper boundary of the chosen temperature range. The execution of the computer instructions by the computer processor 163 causes the controller 162 to hold the temperature of the fluid at the desired temperature. The control of the fluid temperature can be implemented as follows. The controller reads out the temperature of the fluid sensed by the temperature sensor 131. The temperature of the fluid is used as a feedback signal for setting the temperature of the heating element 165 in order to provide the heating of the fluid to the second desired temperature. The functioning of this feedback loop can be implemented using a proportional-integral-derivative algorithm.

After the heating using one or more heating devices 117 the monofilament yarn is textured (curled) in the texturing apparatus 114. The textured (curled) monofilament yarn 122 is cooled using a cooling godet 120. The cooling can be performed by keeping a temperature of a roller 120 of the cooling godet within a predetermined temperature range and/or by air having a temperature within a predetermined temperature range. The textured monofilament yarn 122 can be forwarded further to another roller 121 for further processing.

The sequence of optional processing units, i.e. the cooling godet 97, the drawing device 115, the cooling godet 116, the drawing device 118, the heating godet 117, can be different. It depends on particular processing steps required for preprocessing steps before the texturing (curling) process. Additional drawing devices, and/or heating devices, and/or cooling devices can be included. For instance several heating devices can be used instead of the single heating device 117 depicted in FIG. 1 in order to provide for a gradual heating of the monofilament yarn 119. Alternatively, the preprocessed monofilament yarn can be used for the texturing (curling). In this case there can be no need of the extruder 100, the cooling devices 97 and 116, and the drawing device 115. When drawing process can be executed in several steps, several drawing devices 115 can be used in series.

At least some of the processing units of the system depicted on FIG. 1 can be operated as stand-alone processing units (or groups of units), wherein each of the units (or groups of units) is configured to perform a particular operation, such as extruding, drawing, or texturing. In this case the process can be implemented as reel-to-reel process, wherein yarn is winded on a reel after completion of the operation and winded off the reel for processing the yarn in the next operation. For instance, the extruding process can be performed using the extruder 100 and the cooling device. The texturing process can be executed using a texturing system comprising the texturing apparatus 114 equipped with the heating device 129 and the temperature sensor 158 configured to sense the temperature of the texturing apparatus. In addition the texturing process can be executed using fluid heating element 165 controlled by the controller 162 and/or the yarn heating element 150 controller by the controller 152.

The processing units can be configured such that they process/produce several filaments in parallel. For instance, several filaments can be extruded in parallel using the extruder 100. In this case the spinneret has several holes (e.g. holes like hole 95 depicted on FIG. 2). The drawing device 115 can be configured to process several filaments in parallel. For instance, the rollers 103-105 can be made broad enough to process several filaments in parallel. The same approach can be used for the other units 116, 118, 117, and 115*a* equipped with rollers 81-86, 106, 107, 110-112, 108, 109. The texturing apparatus 114 can be configured to process several filaments in parallel as well. The filaments can be fed into the texturing apparatus through the inlet port 124 of the texturing apparatus 114. After the texturing the filaments can be cooled down using the cooling godet 120.

At least some of processing units of the system depicted on FIG. 1 can be components of a system for manufacturing of an artificial turf. In addition the system for manufacturing of the artificial turf comprises a system for attaching of a textured artificial turf yarn to a backing of the artificial turf. The textured artificial turf yarn can be manufactured using the texturing system. The system for attaching of the textured artificial turf yarn to the backing can comprise a tufting machine being configured to tuft the textured artificial turf yarns through the backing (e.g. stitch/knit the yarns into a sheet of a woven material). The system can further comprise a coating system configured to coat the backing on its back side to adhere the textured artificial turf yarns to the backing. The coating may comprise at least one of acrylic, polyurethane, latex or some combination thereof to assist in preventing the yarns from undesirably detaching from the artificial turf with extended use. The system for attaching of the textured artificial turf yarn to the backing can further comprise another system configured to produce an infill layer of a particular material atop the backing and dispersed among the artificial turf yarn such that portions of the textured artificial turf yarn extend above the infill layer. Utilization of either the backside coating or the infill layer can be optional.

The controller 70 and at least some of the controllers 162 and 152 can have a master-and-slave configuration. The controller 70 can function as a master controller which operates at least one of the slave controllers 152 and 162. In this case the controller 70 can be programmed to hold an actual temperature of the gas-dynamic texturing process performed in the texturing apparatus at the desired temperature, which may be required for the texturing process.

Figure 6:
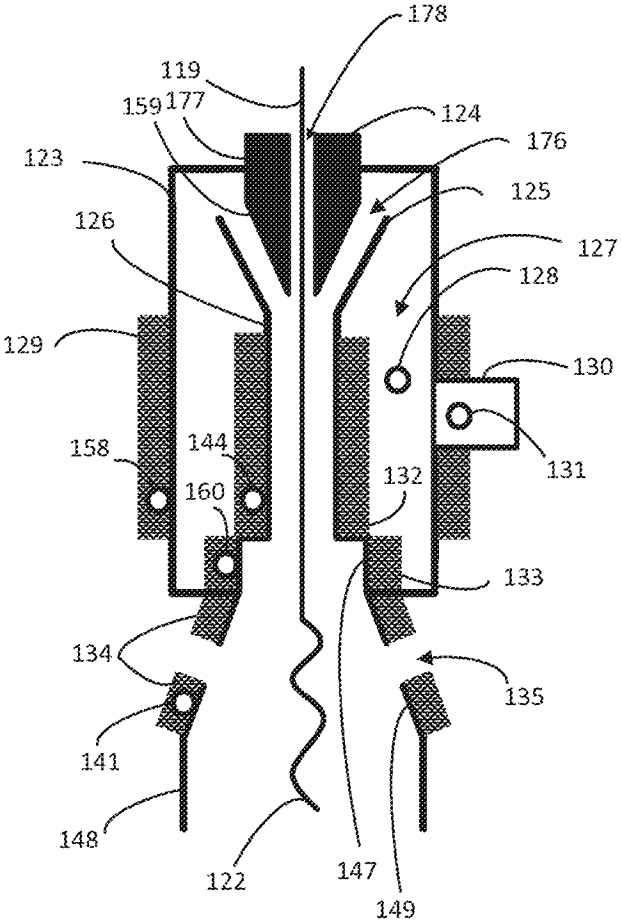
FIG. 6 illustrates an example texturing apparatus.

FIG. 6 depicts the texturing apparatus 114 in greater detail. The texturing apparatus comprises a housing 123. The housing can be a hollow elongated member, which can be implemented as pipe. The pipe can have a length of 0.25-0.35 m and a diameter of 0.2-0.02 m. The inlet port (injector jet) 124 for the one or more filaments is arranged on one end of the elongated member, whereas an expansion chamber is arranged on another end of the elongated member. An inlet 130 for the fluid under pressure used for the texturing process is arranged on a side wall of the elongated member, wherein the inlet 130 is configured for infeed of the fluid inside the housing. The inlet 130 can be a pipe, wherein one end of the pipe has an opening arranged for connecting to the tubing 161 and another end of the pipe has another opening connecting the interiors pipe with the housing. The temperature sensor 131 for sensing the temperature of the fluid can be located in the inlet 130 (or in the pipe of the inlet 130).

A yarn channel 126 is arranged within the housing. The yarn channel can be implemented as a hollow elongated member, e.g. a pipe or conduit. An end portion 125 of the yarn channel has an increasing inner diameter such that an end of the yarn channel has a bigger diameter than a diameter of the yarn channel outside the end portion. The end portion 125 can be funnel shaped. The inlet port 124 is arranged such that it has a threaded bushing 177 for regulating its position in the housing. The inlet port has an channel 178 for infeed of one or more filaments 119 into the yarn channel 126. The inlet has a conical shape 159 adjacent to a portion of the inlet which has the threaded bushing 177. A surface of the conical shape and an inner wall of the end (funneled) portion constitute a channel 176 for infeed of the fluid into the yarn channel 126. The surface of the conical shape and the inner wall of the end portion can be parallel to each other. The inlet port 124 is arranged such that rotation of the threaded bushing 177 results in a change in a distance between the surface of the conical shape and the inner wall of the (funneled) end portion, i.e. in a change in a cross-section of the channel 176. This functionality can be used for tuning of the fluid flow in the yarn channel 126 towards an expansion chamber.

The texturing apparatus 114 is arranged such that an inner wall of the housing 123 and an outer wall of the yarn channel 126 constitute a channel 127 for guiding the fluid from the inlet 130 into the yarn channel 126 via the channel 176. A temperature sensor 128 for sensing the temperature of the fluid can be positioned in the channel 127. The temperature sensor 128 can be used instead temperature sensor 130 for controlling the temperature of the fluid by the controller 162.

The texturing apparatus comprises means for entraining of the one or more filaments 119 (e.g. artificial turf yarn) so that it/they run concurrently with the fluid in the yarn channel 126. These means can be constituted by the channel 176 in the end (funnel) portion of the yarn channel 126, the channel 178 of the inlet port 124, wherein the channel 178 has an opening in the end (funnel) portion as well. The fluid guided by the channel 176 enters the yarn channel 126 and entrains the one or more filaments 119 fed into the texturing apparatus 114 via the channel 178 into the yarn channel 126. In other words, the filaments (yarn strands) are transported downstream the yarn channel by the intake of the fluid. Both, filaments and the fluid move towards an expansion chamber of the texturing apparatus. The fluid stream exerts a tractive force on the filaments (yarn strands) such that they are aspirated into the channel 178 of inlet port (injector jet) 124.

The texturing apparatus comprises further the expansion chamber leading out of the yarn channel downstream thereof. The expansion chamber is arranged at least partially within the housing. The expansion chamber is constituted by a first diffuser component 147 having a fixed inner diameter and a second diffuser component 149 having an increasing inner diameter. The first diffuser component can be implemented as hollow elongated cylindrical member, e.g. a pipe. The second diffusor component can be implemented as a nozzle. The first diffuser component is arranged at an end of the yarn channel being opposite to the end portion of the yarn channel, which has the increasing inner diameter. A diameter of the first diffuser component is bigger than a diameter of the yarn channel. Since these two components are adjacent to each other they constitute a discrete increase in diameter downstream the fluid flow. The second diffuser component and the yarn channel are adjacent to opposite ends of the first diffuser component. Adjacent portions of the first and the second diffuser component have the same diameter. The second diffuser component provides for an increase in diameter downstream the fluid flow. Utilization of the first diffuser component is optional, i.e. the second diffuser component can alone constitute the expansion chamber.

When the filaments and the fluid enter the first diffuser component 147 the flow of the fluid is separated from the wall and outer layers of the flow build vortices or eddies with areas of reversed flow (i.e. the fluid builds a turbulent flow). Inside the first diffuser component the yarn filaments follow the direction of the fluid flow and are thereby deformed. In the second diffuser component 149 the deformed (textured) filaments (strands) are further deformed by the turbulent flow, in addition they are decelerated and form a yarn plug.

The texturing apparatus 114 comprises fluid exhaust means for egress of the fluid from the expansion chamber independently of egress of the artificial turf yarn. These means are needed because the cross-section of the expansion chamber is effectively blocked by the yarn plug. The yarn plug is disintegrated in the lower end of the expansion chamber and guided by a guide tube 148 to the cooling device 120. The exhaust means can comprise openings (e.g. longitudinal exhaust slots 135) in a sidewall of the expansion chamber (e.g. the second diffuser component). The term longitudinal means that the exhaust slots 135 are oriented in the same direction as the flow of the fluid in the yarn channel 126.

Only one heating device 129 and only one temperature sensor 158 for controlling the temperature of the texturing apparatus are depicted on FIG. 1. These components are depicted on FIG. 6 as well. The temperature sensor 158 can be integrated in the heating device 129. Alternatively it can be mounted on the texturing apparatus as an independent component. The heating device 129 can be thermally coupled to the housing 123 through a physical contact. The physical contact can be a direct physical contact between these components, or it can be an indirect physical contact through one or more intermediate solid media such as a thermal paste. For instance, the heating device 129 can be affixed to an external wall of the housing, wherein as option the paste for facilitating thermal conductivity between the heating device and the housing can be used. The heating device 129 can be implemented as a sleeve surrounding/circumventing the housing. The sleeve can be extended such that it further surrounds/circumvents a portion of the expansion chamber which extends from the housing (e.g. the second diffuser component). In this case the sleeve is arranged such that it does not block the fluid exhaust means (e.g. the sleeve has openings for keeping the longitudinal exhaust slots 135 open).

The heat transferred to the housing by the heating device 129 or the heat generated in the housing by the heating device 129 can be transferred further to the other components of the texturing apparatus such as: the yarn channel 126, the inlet port 124, the expansion chamber (the first diffuser component 147, the second diffuser component 149) via thermal coupling between these components. The thermal coupling between these components can be provided through physical contact, which can be a direct or indirect physical contact as explained above. For instance, the thermal coupling can be provided by mechanical clamping of these components to each other, by screwing and/or riveting of these components to each other, by using the thermal paste between these components, by welding these components to each other, or by gluing of these components to each other, etc.

FIG. 6 depicts further options for installing heating devices and temperature sensors. The following pairs of heating devices and temperature sensors can be used in the same way as the heating device 129 and the temperature sensor 158: a heating device 132 configured to heat the yarn channel 126 though physical contact and a temperature sensor 144 integrated into the heating device 132 or configured to sense a temperature of the yarn channel; a heating device 133 configured to heat the first diffuser component 147 though physical contact and a temperature sensor 160 integrated into the heating device 133 or configured to sense the temperature of the first diffuser component 147; a heating device 134 configured to heat the second diffuser component 149 though physical contact and a temperature sensor 141 integrated into the heating device 134 or configured to sense the temperature of the second diffuser component 149. The heating devices 132-134 can be implemented as electrical resistive heaters. They can be in direct physical contact with the respective components, or a solid medium (e.g. thermally conductive paste) can be used between the heating device and the respective component.

Several pairs of heating devices and temperature sensors can be used in parallel for providing advanced (high precision) temperature control of the texturing apparatus. The heating device 129 and the temperature sensor 158 can be used in conjunction with the controller 70 as described above. The heating device 132 (133 or 134) and the temperature sensor 144 (160 or 141) can be used in conjunction with a controller configured in the same way as the controller 70. In this case each of the components has its own control loop and its temperature can be held at the first desired temperature more accurately. For instance, any of the controllers controlling one of the heating devices 129, 132-134 can be configured to control the respective heating device such that the temperature of the respective component is held at the first desired temperature within a tolerance interval of 2%, preferably 1%, more preferably 0.5%.

Preferably, two technological factors have to be maintained constant throughout the texturizing process: (1) the thermal budget of the texturizing process (i.e. energy transferred to the filaments) has to be kept constant in order to avoid changes in the filament temperature in the texturing apparatus, because this temperature determines softening and plasticizing of the filaments; and (2) a stable crimping force must be applied to the filaments in the expansion chamber of the texturing apparatus. In addition, when a bundle of filaments is successfully texturized, it must be carefully cooled without exerting a stretching force. The control of the two technological factors may be of particular importance for the manufacturing of the textured artificial turf yarn with the aforementioned delayed and/or reduced texture reversion.

The first technological factor can be stabilized by minimization of the heat transfer in the texturing apparatus between the filaments and the fluid and minimization of the heat transfer between the fluid and the texturing apparatus. The heat transfer between the texturing apparatus and the filaments can be neglected because its contribution in comparison with the heat transfer between the filaments and the fluid is much less. This can be achieved by configuring the controllers 152, 70, and 162 such that the filament at the inlet port 124 of the texturing apparatus 114, the fluid in the texturing apparatus, and the texturing apparatus 114 itself are held at the same temperature required for the texturing process (the first desired temperature). Since the heating of the texturing apparatus is mainly provided by at least one of the heating devices 129, 132-134, wherein the heating includes variation of heating power in order to compensate for the changes in the heat loss of the texturing apparatus (e.g. due to changes in environment surrounding the texturing apparatus), the changes in the temperature of the fluid are minimized, because both the texturing apparatus and the fluid provided in the texturing apparatus are held at the same temperature. As a result thereof the heat transfer between the texturing apparatus and the fluid and the heat transfer between the fluid and the filaments are minimized. When none of the heating devices is used, the heat transfer between the fluid and the texturing apparatus is the major factor determining the temperature of the texturing apparatus, wherein changes in the heat loss of the texturing apparatus cause substantial changes in the heat transfer between the fluid and the texturing apparatus and as a result thereof the heat transfer between the filaments and the fluid is also substantially changed. This can result in poor texturing properties of the filaments (e.g. shape of the textured filaments and/or mechanical properties of the textured filaments) and/or strong variations in the texturing properties of the filaments. The texturing of the filaments can be evaluated by determining the length of the extended textured filament when a specific force is applied to cause an elongation such that only the crimps are stretched and comparing this length to the original length of the textured filament.

The first technological factor can be further stabilized by preheating the filaments before they enter the inlet port 124 such that they have a temperature of the texturing process immediately before they enter the inlet port 124. Since the filament is cooled during transportation from the heating device 117 (e.g. godet) to the texturing apparatus 114 (distance 156 on FIG. 1), the heating element 150 of the heating device has to be held at a temperature above the temperature of the texturing process, i.e. a temperature offset with respect to the temperature of the texturing process is needed. Depending on the distance between the heating element of the heating device and the inlet port of the texturing apparatus and the environment temperature, the temperature offset can be 0.05 to 0.5° C. The value of the temperature offset can be calculated by Newton's law of cooling $T(t)=T_{env}+(T_0-T_{env})\,e^{-rt}$, wherein T(t) is the temperature at time t, $T_{env}$ is the temperature of the surrounding environment, $T_0$ is the initial temperature of the filament, and r is the cooling coefficient of the filament. The cooling coefficient can be determined by measuring a cooling curve of the filament in a test set-up comprising a temperature sensor configured to sense the temperature of the filament or a polymeric sample made of the same material as the filament (e. g. a thermocouple) and a recorder system configured to register the temperature T(t) via the temperature sensor versus time t in a process of cooling the filament or the polymeric sample from a preselected temperature to the temperature of the environment (e.g. a room temperature). A slope of the T(t) curve on a logarithmic scale is the cooling coefficient r of the cooling curve. The cooling coefficient r of different polyethylene blend compositions determined using this approach is equal to a value of 0.0134 l/s. This comparably small value for the cooling coefficient can be addressed to exothermic crystallization processes in the polymer on cooling.

Using the experimentally determined cooling coefficient the following temperatures of the filament at the inlet port of the texturing apparatus are determined for the following example process parameters: the filament speed of 160 m/min, the distance between the heating element and the inlet port of the texturing apparatus 0.2 m, and the temperature of the heating element 90 degree Celsius. The temperature of the filament at the inlet port is 89.93 degree Celsius, when the temperature of the environment is 15 degree Celsius. The temperature of the filament at the inlet port is 89.94 degree Celsius, when the temperature of the environment is 25 degree Celsius. The temperature of the filament at the inlet port is 89.95 degree Celsius, when the temperature of the environment is 35 degree Celsius. The elapsed time from a point in time when the filament is detached from a surface of the heating element, to a point in time when the filament enters the inlet port, is calculated by dividing the distance by the filament speed.

The first technological factor can be further stabilized by minimization of the distance 156 between the heating element 150 of the heating device and the inlet port 124 of the texturing apparatus 114. The distance can be less than 0.1 m, preferably less than 0.04 m.

The second technological factor can be stabilized by providing a stable gas dynamic parameters of the fluid flow in the texturing apparatus, in particular in the expansion chamber of the texturing apparatus. When the fluid enters the expansion chamber of the texturing apparatus, its flow velocity, pressure, density and temperature change. The expansion chamber functions as a diffuser, i.e. it decelerates the flow velocity of the fluid. The filaments inside the expansion chamber are also decelerated and swirled around. Frictional abrasion occurs by contact with the inner walls of the expansion chamber and/or by filament-to-filament contact. Thereby debris (e.g. a fine particulate matter) is generated. The particulate matter originates from the surface of the filaments and is transferred to the components of the texturing device by the exiting fluid flow. Shortly after the texturing process has started, there is no particulate matter observable on the texturing apparatus, but, after a period of time, the particulate matter appears on the texturing apparatus (in particular on the inner and outer walls of the expansion chamber). Initially It can build up a layer of a few micrometres. The layer gets thicker with time and extends also to the housing the texturing apparatus. Building of this layer can compromise the performance of the texturing apparatus. First, it can affect thermal exchange with the environment and as a consequence change the temperature of the at least some components of the texturing apparatus such as the expansion chamber. This influence can be compensated at least partially by utilization of one or more heating devices 129, 132-134 as described above. Second, the building of the layer can change the performance of the expansion chamber such that the gas dynamic parameters of the fluid flow therein are changed, e.g. the layer can change the performance of the fluid exhaust means in the expansion chamber. For instance it can at least partially clog the longitudinal exhaust slots 135. As a result thereof the fluid flow in the expansion chamber can change and the crimping force can differ after the building of the layer.

This problem can be remedied by utilization of cleaning means for removing the debris, e.g. brushing the outer surface of the texturing apparatus (e.g. the outer surface of the expansion chamber and/or the outer surface of the housing). The cleaning means can remove the debris from the fluid exhaust openings (the longitudinal exhaust slots 135). As a result thereof the stabilization of the gas dynamic parameters of the fluid flow in the texturing apparatus can be achieved. In addition the influence of the debris on the heat exchange of the texturing apparatus with the environment is reduced as well. The cleaning can be performed without interruption of the texturing process.

Figure 7:
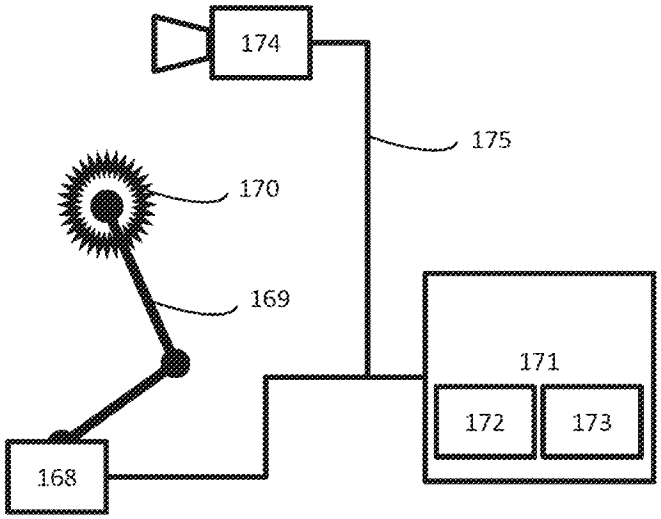
FIG. 7 illustrates an example brushing means.

The cleaning means can be implemented as a brush 170 depicted on FIG. 7. The brush can be mounted on a robotic arm 169 mounted on a stage 168. The robotic arm 169 and the brush 170 can be operated by a controller 171 comprising a processor 172 and a memory 173 storing instructions executable by the processor 172. Execution of the instructions by the processor 172 causes the controller 171 to operate the robotic arm 169 and the brush 170 such that the debris are removed from the texturing apparatus as described above. The removal of the debris can be performed on a periodic basis during the texturing process. Alternatively or in addition a video inspection means (e.g. video camera 174) can be used for determination of points in time when the cleaning has to be performed. The controller can be configured to register the building of the debris on the texturing apparatus using the video inspection means. The registered images of the texturing apparatus are analyzed by the controller in order to evaluate the building of the debris layer. When the controller determines that the debris layer is build up to a critical level it can trigger the cleaning procedure. The critical level can be determined as a percentage of the surface of the texturing apparatus covered by the debris layer, and/or as a change in color of a component of the texturing apparatus. The texturing apparatus can be painted such that the building up of the debris layer changes its color. For instance, the paint of the texturing apparatus and a color of the filaments can be different.

In most cases the texturing apparatus is a cylindrical column with a length of some 300 mm and a diameter of some 20 mm.

An example of a successfully tested texturing apparatus is described herein as follows. The texturing apparatus has an overall length of 0.255 m without a guide tube. The yarn channel with screwed in inlet port (infeed valve) has a length of 0.155 m and the expansion chamber (stuffer box) has a length of 0.1 m. The outer diameter of the texturing apparatus is 0.022 m. A heating coil with a length of 0.065 m is attached to the upper part of the texturing apparatus. The heating coil has an integrated thermocouple. A controller is connected to the heating coil. The temperature is set to 90° C. Heated pressurized air is used as a fluid. The air temperature is set to 90° C. The pressure is set to 700000 Pa. The fluid flow is adjusted to 1.67 l/s. A polymer blend is prepared from LLDPE with a density of 917 g/l and HDPE with a density of 955 g/l and a master-batch with a density of 940 g/l. The polymer blend is extruded, spun to 144 filaments, drawn to a ratio of 1:5.6 and conducted to the texturing machines. 6 filaments with a breadth of 1 mm and a thickness of 0.2 mm are fed into one of the texturing machines. The feeding godets are located 200 mm above the texturing machine. The godets are heated to 90.1° C. in accordance with the approach described above, wherein an environment temperature is 25° C. and an experimentally determined cooling coefficient r is 0.0134 l/s, and a yarn speed is 170 m/min With these settings the filaments are at a temperature slightly higher than 90° C. when they enter the texturing machine.

The textured (curled) monofilament yarn, which can be used as the artificial turf fibers can be prepared from a polymer blend comprising at least two polymers. The polymer blend can be a more complex mixture. The polymer blend can be at least a three phase system. It can comprise a first polymer, a second polymer, and a compatibilizer. These components form a three-phase system. The first and a second polymer are immiscible. If there are additional polymers or compatibilizers are used in the polymer blend, then the three phase system may be increased to a four, five or more phase system. The first polymer could be or comprise polyamide (PA) and the second polymer could be or comprise polyethylene (PE). This polymer blend (mixture) comprising PE and PA may be of particular advantage for manufacturing of a (stretched and) textured monofilament yarn with reduced and/or delayed texture reversion, when the (stretched and) textured monofilament yarn is used as the textured artificial yarn in the artificial turf. The polymer blend can comprise a polar polymer and a non-polar polymer. The polymer blend can comprise at least one of the following: polyethylene terephthalate, which is also commonly abbreviated as PET, polybutylene terephthalate, which is also commonly abbreviated as PBT, polyethylene, polypropylene.

The compatibilizer can be any one of the following: a maleic acid grafted on polyethylene or polyamide; a maleic anhydride grafted on free radical initiated graft copolymer of polyethylene, SEBS, EVA, EPD, or polyproplyene with an unsaturated acid or its anhydride such as maleic acid, glycidyl methacrylate, ricinoloxazoline maleinate; a graft copolymer of SEBS with glycidyl methacrylate, a graft copolymer of EVA with mercaptoacetic acid and maleic anhydride; a graft copolymer of EPDM with maleic anhydride; a graft copolymer of polypropylene with maleic anhydride; a polyolefin-graft-polyamide; and a polyacrylic acid type compatibilizer.

For instance, the textured (curled) monofilament yarn, which can be used as the artificial turf fibers can be prepared from polyethylene based polymers. Different polyethylene (type) based polymers are blended such that a desired property profile is created. The main focus hereby lies on the crimp properties of the monofilament yarn and/or reduction and/or delaying the aforementioned texture reversion.

The polymer blend can comprise LLDPE and HDPE. LLDPE is a copolymer of ethylene and α-olefin or 1-olefin. Several 1-olefins can be copolymerized together with ethylene, but most of the commercially available LLDPEs are copolymers with 1-butene, 1-hexene or 1-octene, or mixtures thereof, as co-monomers. In a polymerization process, both the monomer ethylene and the co-monomer 1-olefin are incorporated step-by-step into a growing macromolecular chain. In each single step either an ethylene molecule or a 1-olefin molecule is added to the chain.

The sequence of ethylene and 1-olefin units along the chain is determined by both, the polymerization catalysts and the details of the reaction layout, such as pressure, temperature, etc. In general, there are two distinctive types of catalysts; multi-site catalysts and single-site catalysts. The type of catalyst controls the polymerization progress and the way in which monomers and co-monomers are added to the polymer chain. Polymers are always entities of macromolecules with different chain length, distributed around an average value. Polymers are thus characterized by a molecular weight distribution. Different average values can be defined depending on statistical methods. In practice two averages are used, denoted as $M_n$ and Mw. $M_n$ is the number average of the molecular weight distribution, mathematically expressed by $$M_n = \Sigma n_i M_i / \Sigma n_i$$

MW is the weight average of the molecular weight distribution and is related to the fact that heavier molecules contribute more to the arithmetic average than the lighter ones. This is mathematically expressed by $$Mw=\Sigma n_i M_i^2/\Sigma n_i$$

The polydispersity index PDI is the ratio of $Mw/M_n$ and indicates the broadness of the distribution. In general, polymers prepared with multi-site catalysts have a greater PDI than those prepared with single-site catalysts.

Moreover, the chemical composition of the macromolecules depends on the type of catalyst. As mentioned above, every 1-olefin or α-olefin can act as a co-monomer in the polymerization process, but typically only 1-butene, 1-hexene and 1-octene is in use for copolymerization of LLDPE. As these molecules carry a double bond between two carbon atoms, it is possible to insert them instead of an ethylene molecule into the growing chain of the macromolecule which forms in the polymerization process. The incorporation of a 1-olefin molecule into the polymer main chain leaves, other than ethylene does, a side chain on the main chain. 1-butene, for instance, includes 4 carbon atoms and generates an ethyl side chain, whereas two carbon atoms (the two with the double bond between carbon atoms 1 and 2) are incorporated into the main chain and another two carbon atoms extent outwardly of that main chain as a side chain. In case of 1-hexene the length of the side chain is 4 carbon atoms and it is 6 with 1-octene. Concerning the side chain distribution, the molecular architecture may greatly be influenced by the choice of the catalyst used in the polymerization process. Multi-site catalysts, also referred to as Ziegler or Ziegler-Natta catalysts or Phillips catalysts, yield in heterogeneously branched polymers, whereas single-site catalysts, also referred to as metallocene catalysts, yield in homogeneously branched polymers. In heterogeneously branched macromolecules the distance from one branching point to another branching point is broadly distributed along the polymer main chain. The other way round, the branches are more evenly spaced in homogeneous branched LLDPEs. It has also been observed that with Ziegler catalysts the co-monomers are preferably incorporated into the short length main chains, while the longer main chains deplete of co-monomers. Depending on the design of the polymerization process the side chain branching is heterogeneous or homogeneous.

The use of multi-site catalysts results in polymers with relatively broad molecular weight distributions compared with single-site catalysts. Moreover, the molecular weight distribution can be influenced by using a cascaded reactor layout, leading to polymers with multimodal molecular weight distributions. Blending different types of polyethylene in situ, i. e. inside the polymerization reactor, or ex situ, i. e. after polymerization, broadens the variety further.

Number, length and distribution of the side chains in PE macromolecules greatly influence the properties and the processability. According to applicant's experience, it is advantageous to use LLDPE with a broad distribution of side chains, typical for Ziegler-catalyzed, solution polymerized polymers for turf fiber production, in particular for texturized turf fiber production. The fraction of short length polymer chains with high branching makes the fibers, produced of these LLDPE-types, easy to texturize. In the course of the texturizing process the fibers need to be softened under the influence of heat and then deformed, such that a wanted crimped shape results and stays on the fibers. It has turned out that the above mentioned LLDPE-types are appropriate for this process.

Preferably, in the texturizing (curling) process a certain fraction of the polymeric filament (i.e. monofilament yarn) must be in a molten state, i. e. the small crystallites of the structure have lost their ordered state, whereas another fraction has not. This means, that the filaments ought to be stable enough not to adhere or lump and deformable enough to crimp under the impact of heat and mechanical deformation. Once the deformation is achieved, the filaments are quenched giving rise to crystallization of the small crystallites. Thereby the texturizing stays in the filaments.

Texturizing is supported by both, the chemical structure of the polymeric filaments and the temperature of the filaments at the moment of deformation. Both can be appraised by knowledge of the melting behavior of the polymeric filaments. The melting behavior manifests in a characteristic melting graph detected by DSC. In a characteristic melting graph, measured by DSC, the variation of the melt enthalpy (heat flow) over time, i. e. dH/dt is plotted against the variation in temperature over time, i. e. dT/dt. The melt enthalpy ΔH or heat of fusion can be calculated by mathematical integration, i. e. the determination of the area between the baseline and the complete curve or parts thereof. This reflects the amount of heat necessary to completely or partially melt the sample.

Polymers herein are generally of the type of partially crystalline substances. Partially crystalline polymers are characterized in that a part thereof is solid crystals, while the rest is amorphous. The amorphous part behaves as a highly viscous liquid. Liquid parts of a polymer sample do not contribute to the melting process. The melting curve as detected by DSC reflects the melting behavior of the crystallites.

Number and size of the crystallites determine the density of polymers. LLDPE has a lower density compared with HDPE. Combining LLDPE and HDPE into a blend may have the advantage to broaden the melting curve. The melting curves of LLDPE are quite specifiable, depending on what type of LLDPE is regarded. As already mentioned, the co-monomer, the catalyst and the type of process layout have a great influence on the appearance of the melting curve. There are three types of processes for the preparation of LLDPE: slurry, solution and gas-phase. The slurry-process is underrepresented in this context, as very few LLDPE-types exist. But, it is the method of choice of the production of HDPE. LLDPE from solution processes is characterized in that mostly 1-octene acts as co-monomer in that process. Contrariwise 1-hexene and 1-butene are the co-monomers used in gas-phase processes.

The composition of an example polymeric blend used for manufacturing of the textured (curled) monofilament yarn comprises:

(A) 10% by weight of the total composition to 95% by weight of the total composition of at least one LLDPE having
- a density of 915 to 920 grams per liter,
- a melt index ($I_2$) from 1 to 10 grams per 10 minutes,
- a polydispersity $Mw/M_n$ in a range of 3-5, in particular,
- 1-olefin comonomers, the comonomers being 1-butene, 1-hexene or 1-octene or compositions thereof,
- a heterogeneously or homogeneously side branching distribution,
- a melting graph as measured by DSC with one, two or three maxima in the temperature range between 30° C. and 150° C., wherein the number of maxima is determined by a number of polymorphic modifications of the LLDPE used in this example polymeric blend, the maxima can be isothermal, overlapping, or co-located; and (B) 10% by weight of the total composition to 30% by weight of the total composition of at least one HDPE having
- a density of 935 to 960 grams per liter,
- a melt index ($I_2$) from 1 to 10 grams per 10 minutes,
- a polydispersity index $Mw/M_n$ in a range of 3-6, in particular,
- 1-olefin comonomers, the comonomers being 1-butene, 1-hexene or 1-octene or compositions thereof,
- a heterogeneously side branching distribution,
- a melting graph as measured by DSC with one maximum in the temperature range between 30° C. and 150° C.

The polymeric blends used for the manufacturing of the (texturized) filaments are characterized by a melting graph measured by DSC. The DSC method is widely used for thermal analysis. The method offers a fast and easy determination of phase transitions, e. g. melting, glass transition, and crystallization of polymer samples.

In a DSC analysis the energy is measured as a heat flow into or out of the sample. The vertical axis of a DSC plot is given in units of mW or mJ/s, whereas the horizontal axis shows the temperature in ° C. In a DSC run the sample is placed in a small metal pan and the measured against an empty metal pan. The temperature is raised (or lowered) at a constant rate dT/dt, mostly 10° C./min or 20° C./min and the pans are heated separately. When a phase transition occurs in the sample the uptake of energy (or the release of energy) is compensated by the furnace under the sample pan as long as necessary to maintain the heating (or cooling) rate and recorded as the energy flow. As the experiment is always done under constant pressure the energy flow is represented by a change in enthalpy ΔH. Then dH/dt equals $C_p$ dT/dt, wherein $C_p$ is the heat capacity of the sample.

The enthalpy of the complete melting process ΔH can be calculated by mathematical integration of the DSC trace, i. e. $\Delta H=\int(dH)\,dT$. Therefor a baseline (which is not plotted automatically throughout a DSC run) is needed. This baseline has to be interpolated as flat baseline, when the DSC curve follows the same progression in the segments of the curve before and after the phase transition. However this is often not the case, because $C_p$ may not be the same before and after the phase transition, moreover $C_p$ can depend on temperature. In cases, where a step in $C_p$ is present, an interpolation using sigmoid function is suitable for the construction of the baseline. The interpolation reflects the extent of progress of the transition. At each point of the interpolated baseline, i. e. each temperature in the region of the peak, difference in $C_p$ is calculated by linear extrapolation of the left pre-transition side and the right post-transition side of the curve and then weighted by the extent of progress of the transition. Besides interpolation using sigmoid function interpolation using other functions like cubic of step functions can be used.

Once the baseline has been constructed, a left and a right limit for the integral must be defined, which gives rise to another discussion. When analyzing LLDPE with the DSC-method, the left limit is often hard to find in the temperature range between ambient and end of melting. This is because LLDPE may be partly melted at ambient temperatures. A cooling device and a purge gas device are necessary to extend the range to temperatures lower than ambient.

Figure 8:
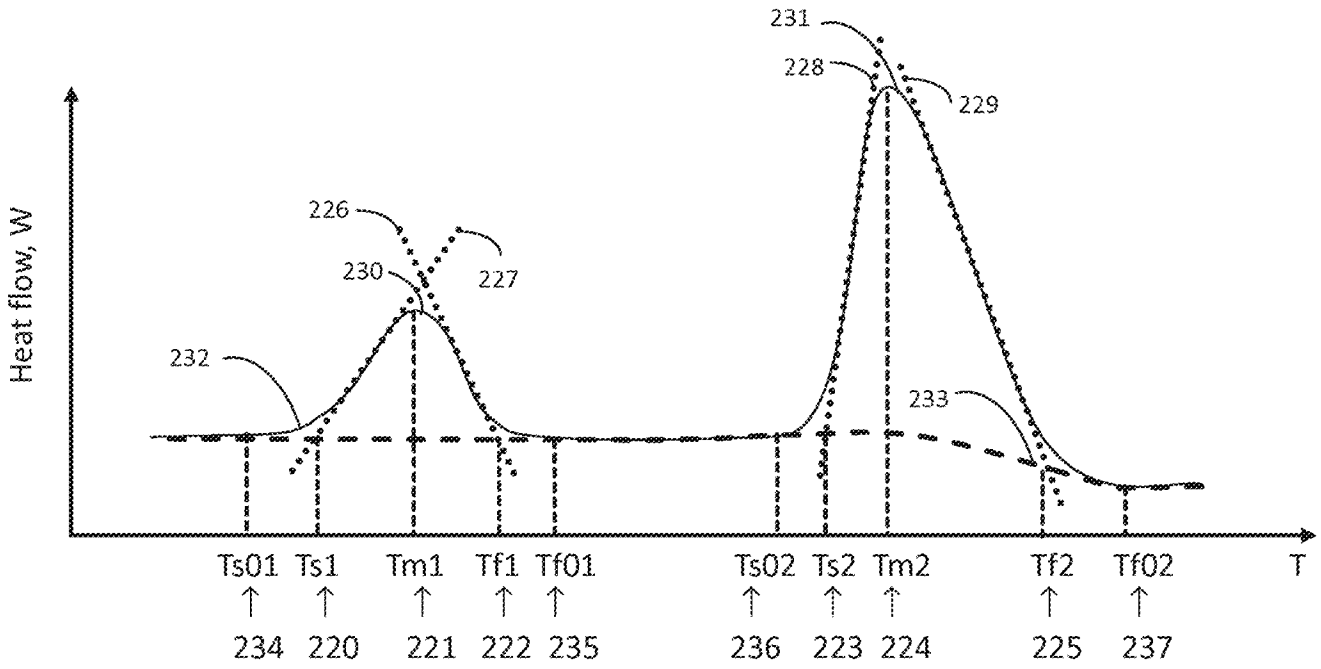
FIG. 8 illustrates an example DSC curve.

An example DSC graph is depicted in FIG. 8. The DSC graph represents schematically an example curve 232 of a heat flow (W) versus temperature. A peak 230 of the curve 232 corresponds to a melting of a one polymer of the blend (e.g. polymer 138). This polymer is called further in the description related to this figure as the first polymer. A peak 231 of the curve 232 corresponds to a melting of another polymer of the blend (e.g. polymer 137). This polymer is called further in the description related to this figure as the second polymer. The first and the second polymers do not have polymorphism. The curve 232 has the following characteristic temperatures: Ts01 (234), Ts1 (220), Tm1 (221), Tf1 (222,) Tf01 (235), Ts02 (236), Ts2 (223), Tm2 (224), Tf2 (225), Tf02 (237).

Each peak of the curve 232 has the following characteristic temperatures:

a) Ts01 (Ts02) is a temperature at which the curve 233 starts to deviate from the base line 233. This temperature characterizes the beginning of the melting process;

b) Ts1 (Ts2) is a temperature characterizing substantial beginning of the melting process. At this temperature a substantial portion of the crystalline fraction of the first (second) polymer is molten. As usual this temperature is called a lower boundary of a melting range of a melting process or a melting point. The temperature Ts1 (Ts2) is a temperature at which the tangent line 227 (228) intersects the base line 233. The tangent line 227 (228) is a tangent to a left slope of the peak 230 (231). The tangent line has the same first derivative as the left slope of the peak at a temperature at which the left slope of the peak 230 (231) has its second derivative equal to zero;

c) Tm1 (Tm2) is a temperature at which the peak 230 (231) has its maximum. This temperature (as usual) indicates the temperature at which the melting process has the highest rate;

d) Tf1 (Tf2) is a temperature characterizing substantial ending of the melting process. At this temperature the crystalline fraction of the first (second) polymer is almost completely molten. As usual this temperature is called an upper boundary of the melting range of the melting process. The temperature Tf1 (Tf2) is a temperature at which the tangent line 226 (229) intersects the base line 233. The tangent line 226 (229) is a tangent to a right slope of the peak 230 (231). The tangent line has the same first derivative as the right slope of the peak at a temperature at which the right slope of the peak 230 (231) has its second derivative equal to zero;

e) Tf01 (Tf02) is a temperature at which the curve 233 starts to coincide with the base line 233. This temperature characterizes the complete end of the melting process. At this temperature the crystalline fraction of the first (second) polymer is completely molten.

The dashed line 233 is a base line of the DSC curve. The base line of the peak 230 is straight, because the melting of the crystalline fraction of the first polymer does not result in a change in the heat capacity (Cp) of the first polymer and as a result thereof in the change of the heat capacity of the polymer blend. The base line of the peak 231 is a sigmoidal baseline because the melting of the crystalline fraction of the second polymer results in a change in the specific heat capacity of the second polymer and as a result thereof in the specific heat capacity of the polymer blend. The sigmoidal base line can be any suitable sigmoidal function.

The parameters used for determination of a process window of texturing (curling) of the monofilament yarn can be derived using the following definitions and/or procedures.

First the DSC curve can be preprocessed. The contribution of the base line can be subtracted from the original DSC curve. In other words each value of the preprocessed DSC curve at a particular temperature is equal to a value of the original DSC curve at said temperature minus a value of the baseline curve at said temperature. For further steps, either the original or the preprocessed DSC curve can be used. In case when peaks of the DSC curve overlap, a deconvolution of the overlapping peaks can be performed in order to provide processing of each of the overlapping peaks in an independent way. Afterwards the temperatures specified in sections a)-e) are determined.

The lower (upper) boundary value of the temperature range for the texturing (curling) process can be one of the following temperatures: Ts01, Ts1, Tm1, Tf1, Tf01, Ts02, and Ts2 (Ts1, Tm1, Tf1, Tf01, Ts02, Ts2, Tm2), wherein the lower boundary value is less than the upper boundary value. For instance, the temperature range Tf01-Ts02 can be selected when it is required that the crystalline fraction of the first polymer is completely molten and the crystalline fraction of the second polymer is completely in the solid state in the process of the texturing (curling) of the monofilament yarn. Alternatively, the temperature range Tf01-Tm2 can be selected, when it is required that the crystalline fraction of the first polymer is completely molten and the crystalline fraction of the second polymer is partially molten in the process of the texturing (curling) of the monofilament yarn. As yet another alternative, the temperature range Tm1-Tf1 can be selected, when it is required that the crystalline fraction of the first polymer is partially molten and the crystalline fraction of the second polymer is completely in the solid state in the process of the texturing (curling) of the monofilament yarn. As yet another alternative Tm1 can be taken as a reference temperature $T_R$ for the texturing (curling) process. Since the temperature of the filaments should not fall below the reference temperature $T_R$ during the course of texturizing the filaments, a lower boundary and an upper boundary of the temperature range can be defined as follows: the lower boundary is equal to $T_R$ and the upper boundary is equal to a surplus temperature $T_S$, wherein the surplus temperature $T_S$ being no more than a predetermined percentage larger than the lower boundary temperature in degrees Celsius, wherein the predetermined percentage is 15%, preferably 10%, and more preferably 5%.

Figure 9:
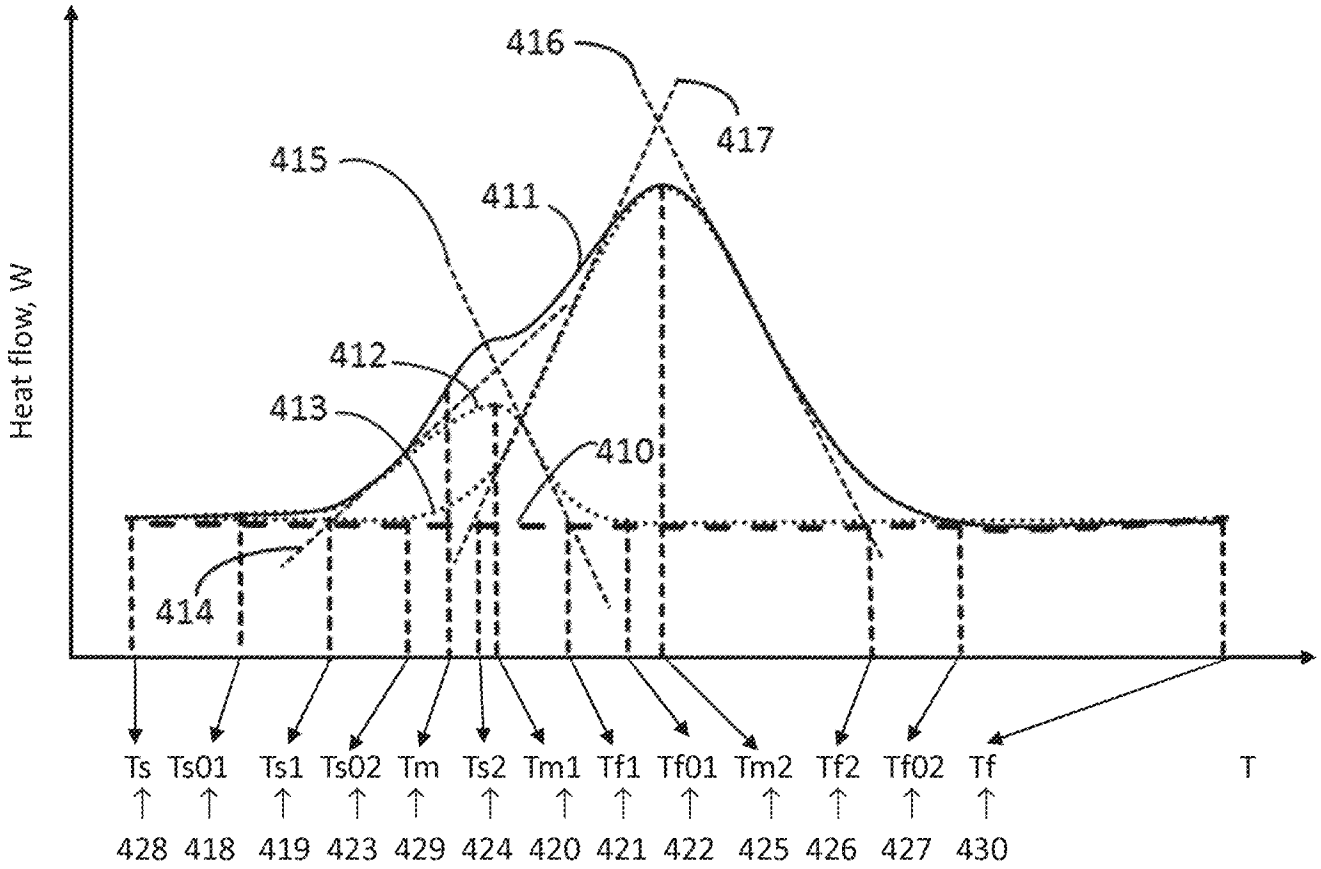
FIG. 9 illustrates an example DSC curve.

Another example DSC graph is depicted in FIG. 9. The DSC graph represents schematically an example curve 411 of a heat flow (W) versus temperature. The DSC curve is a cooling or heating curve of a polymer blend comprising two different polymers each having no polymorphism. In this example the melting temperatures of the polymers of the blend are close to each other. As a result thereof the curve 411 has only one maximum at Tm2 temperature 425. Merely for illustrative purposes a base line 410 of the curve 411 is flat (a horizontal line). Alternatively the curve 411 can be a preprocessed curve having contribution of the non-flat base line (e.g. the base line 233 in FIG. 8) subtracted from the original DSC curve.

Being not bound to the example curve depicted in FIG. 9 the overlapping peaks constituting an integral DSC curve can be extracted using a deconvolution procedure. The deconvolution can be performed for instance using the Stokes method with Gaussian smoothing, the method based on decomposition of a DSC curve into a Fourier series, or the method based on the decomposition of a DSC curve into a linear combination of instrumental functions. After extraction of the overlapping peaks each of them can be processed as described above.

Deconvolution of the curve 411 results in the generation of two curves 412 and 413 each representing a respective peak. One curve (e.g. 412) is a characteristic of a melting process of one of the polymers of the blend, while the other curve (e.g. 413) is a characteristic of a melting process of the other polymer of the blend. As clearly seen from FIG. 9 the peaks represented by the curves 412 and 413 overlap. The curves 412 and 413 can be further processed in the same way as described above. Processing of the curve 412 results in determination of the following parameters: Ts01 temperature 418 having the same physical meaning as the Ts01 temperature 234 or the Ts02 temperature 236 in FIG. 8; Ts1 temperature 419 having the same physical meaning as the Ts1 temperature 220 or the Ts2 temperature 223 in FIG. 8, wherein Ts1 temperature 419 is determined using a tangent line 414 in the same way as Ts1 temperature 220 is determined using the tangent line 227; Tm1 temperature 420 having the same physical meaning as the Tm1 temperature 221 or the Tm2 temperature 224 in FIG. 8; Tf1 temperature 421 having the same physical meaning as the Tf1 temperature 222 or the Tf2 temperature 225 in FIG. 8, wherein the Tf1 temperature 421 is determined using the tangent line 415 in the same way as Tf1 temperature 222 is determined the tangent line 226; Tf01 temperature 422 having the same physical meaning as the Tf01 235 temperature or the Tf02 237 temperature in FIG. 8. Processing of the curve 413 results in determination of the following parameters: Ts02 temperature 423 having the same physical meaning as the Ts01 temperature 234 or the Ts02 temperature 236 in FIG. 8; Ts2 temperature 424 having the same physical meaning as the Ts1 temperature 220 or the Ts2 temperature 223 in FIG. 8, wherein Ts2 temperature 419 is determined using a tangent line 416 in the same way as Ts1 temperature 220 is determined using the tangent line 227; Tm2 temperature 425 having the same physical meaning as the Tm1 temperature 221 or the Tm2 temperature 224 in FIG. 8; Tf2 temperature 426 having the same physical meaning as the Tf1 temperature 222 or the Tf2 temperature 225 in FIG. 8, wherein the Tf2 temperature 426 is determined using the tangent line 416 in the same way as Tf1 temperature 222 is determined the tangent line 226; Tf01 temperature 427 having the same physical meaning as the Tf01 temperature 235 or the Tf02 temperature 237 in FIG. 8.

The lower (upper) boundary value of the temperature range for the texturing (curling) process can be selected in the same way as described above.

Figure 10:
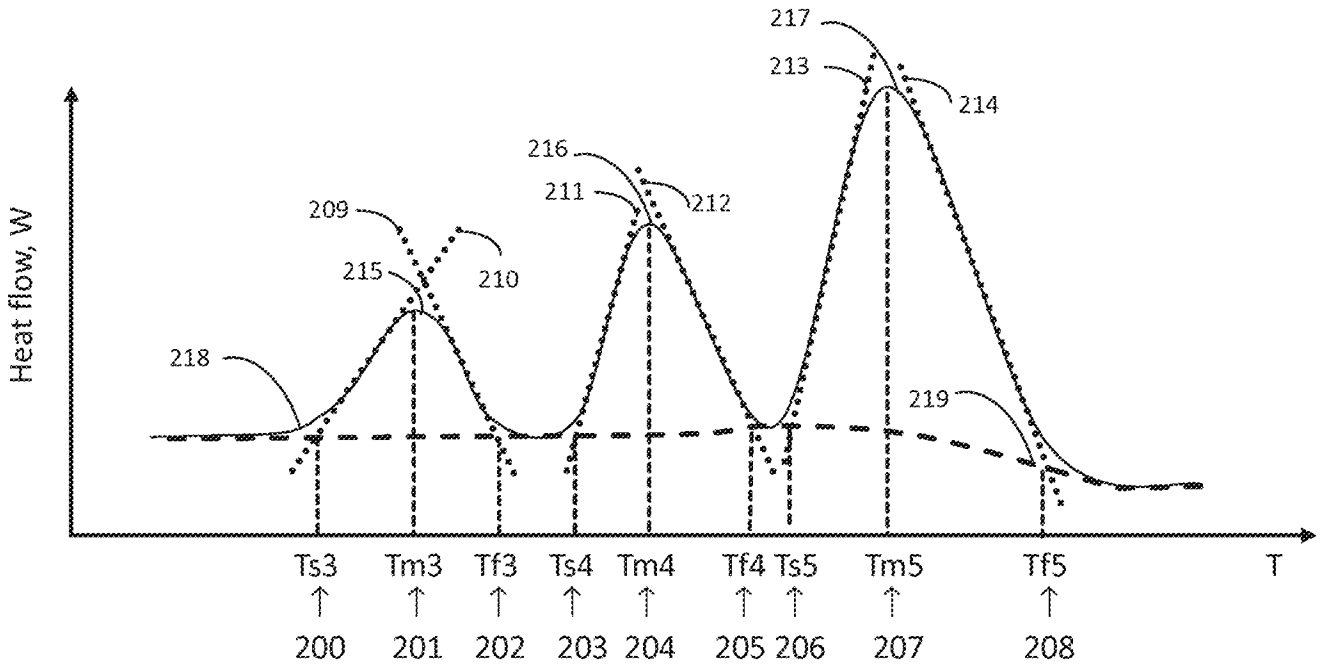
FIG. 10 illustrates an example DSC curve.

Another example DSC graph is depicted in FIG. 10. The DSC graph represents schematically a curve 218 of a heat flow (W) versus temperature. In contrast to polymer blend which DSC curve depicted in FIG. 8, one polymer of a polymer blend has two polymorphic modifications and another one polymer of a polymer blend does not have polymorphism. The polymer having polymorphism is called further as the third polymer in the description of FIG. 10. The polymer having no polymorphism is called further as the fourth polymer in the description of FIG. 10. Peak 215 corresponds to a melting of one of the polymorphic modifications of the third polymer. Peak 216 corresponds to a melting of another one of the polymorphic modifications of the third polymer. Peak 217 corresponds to a melting of a crystalline fraction of the fourth polymer. The base line curve 219 is defined in the same way as described above. Tm3 (201), Tm4 (204), and Tm5 (207) are defined as specified above in section c). Ts3 (200), Ts4 (203), Ts5 (206) are defined using tangent lines 210, 211, and 213 as specified above in section b). Tf3 (202), Tf4 (205), Tf5 (208) are defined using tangent lines 209, 212, and 214 as specified above in section d). The temperatures equivalent to Ts01 and Tf01 are defined as specified above in points a) and e). These temperatures are not depicted in FIG. 10 merely for illustrative purposes. Ts5, Tm5, Tf5 have the same physical meaning as Ts2, Tm2, and Tf2. Ts3 and Tf4 have the same physical meaning as Ts1 and Tf2. In contrast to Ts1, Tm1, and Tf1 which characterize the melting process of entire crystalline fraction of the first polymer, Ts3, Tm3, and Tf3 (Ts4, Tm4, and Tf4) characterize the melting process of only one of the polymorphic modifications of the third polymer. Ts3, Tm3, and Tf3 (Ts4, Tm4, and Tf4) have the same physical meaning for the characterization of the melting process of the polymorphic modification as Ts1, Tm1, and Tf1 for the characterization of the melting process of the crystalline fraction of the polymer.

In the example depicted in FIG. 10 the lower (upper) boundary value of the temperature range for the texturing (curling) process can be one of the following temperatures: Ts3, Tm3, Tf3, Ts4, Tm4, Tf4 and Ts5 (Tm3, Tf3, Ts4, Tm4, Tf4, Ts5, and Tm5), wherein the lower boundary value is less than the upper boundary value. For instance, the temperature range Tf4-Ts5 can be selected when it is required that the crystalline fraction of the third polymer is almost completely molten and the crystalline fraction of the fourth polymer is almost completely in the solid state in the process of the texturing (curling) of the monofilament yarn. Alternatively, the temperature range Tm3-Tf3 can be selected, when it is required that the only one of the polymorphic modifications of the third polymer is substantially molten and the rest of the crystalline fraction of the polymer blend is in a solid state in the process of the texturing (curling) of the monofilament yarn. As yet another alternative, the temperature range Ts4-Tm4 can be selected, when it is required that the one of the polymorphic modifications of the third polymer is completely molten, another one of the polymorphic modifications of the third polymer is only partially molten, and the crystalline fraction of the fourth polymer is in the solid state in the process of the texturing (curling) of the monofilament yarn. As yet another alternative Tm4 can be taken as a reference temperature $T_R$ for the texturing (curling) process. Since the temperature of the filaments should not fall below the reference temperature $T_R$ during the course of texturizing the filaments, a lower boundary and an upper boundary of the temperature range can be defined as follows: the lower boundary is equal to $T_R$ and the upper boundary is equal to a surplus temperature $T_S$, wherein the surplus temperature $T_S$ being no more than a predetermined percentage larger than the lower boundary temperature in degrees Celsius, wherein the predetermined percentage is 15%, preferably 10%, and more preferably 5%.

Independent from a particular structure of a DSC curve (e.g. number of peaks, overlapping/non overlapping peaks, etc.) another approach can be used for determination of the temperature range used for texturing (curling) process. The lower boundary Tl of the temperature range is determined according to the following equation:

$$\frac{\int_{Ts}^{Tl}(\text{Heat flow}(T)-\text{Base line }(T))dT}{\int_{Ts}^{Tf}(\text{Heat flow}(T)-\text{Base line }(T))dT}=\alpha 1,$$

and the upper boundary Tu is determined according to the following equation:

$$\frac{\int_{Ts}^{Tu}(\text{Heat flow}(T)-\text{Base line }(T))dT}{\int_{Ts}^{Tf}(\text{Heat flow}(T)-\text{Base line }(T))dT}=\alpha 2.$$

Heat flow (T) is the original DSC curve (e.g. DSC curve 411 in FIG. 9). Base line (T) is a temperature dependent base line of the original DSC curve (e.g. base line 410 in FIG. 9). Ts is a lower boundary of a temperature range of the DSC curve (e.g. Ts (428) in FIG. 9). At this temperature the DSC curve coincides with its base line. Tf is an upper boundary of a temperature range of the DSC curve (e.g. Tf (428) in FIG. 9). At this temperature the DSC curve coincides with its base line. The following constrains apply for the equations above: $Ts<Tf$, $0<\alpha 1<\alpha 2<1$. $\alpha 1$ can be equal to 0.05, preferably to 0.09. $\alpha 2$ can be equal to 0.15, preferably to 0.11. The melting temperature Tm (e.g. Tm 429 in FIG. 9) can be determined as $Tl<Tm<Tu$. At Tm 429 a portion of a crystalline fraction of one of the polymers of the polymer blend and a portion of a crystalline fraction of the other one of the polymers of the polymer blend are in a molten state and another portion of the crystalline fraction of the one of the polymers of the polymer blend and another portion of the crystalline fraction of the other one of the polymers of the polymer blend are in a solid state.

With independent of the particular temperature range selected as the temperature range of the texturing process the desired temperature can be determined as a middle temperature of the selected temperature range. The desired temperature is equal to an average of an upper boundary of the selected temperature range and the lower boundary of the selected temperature range. The desired temperature can be used as the setting of the controller 70, i.e. be used as the desired temperature therein. In addition or as alternative the desired temperature can be specified as the selected temperature range or a range within the selected temperature range (e.g. a subrange of the selected temperature range).

Figures 11, 12, 13, 14:
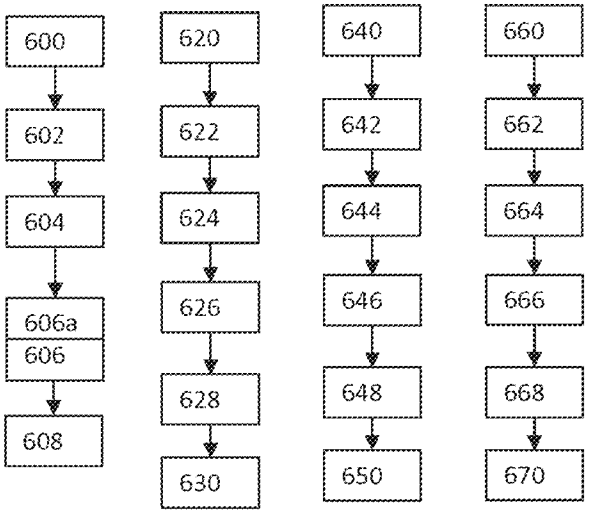
FIG. 11 shows a flow chart of a method.
FIG. 12 shows a flow chart of a method.
FIG. 13 shows a flow chart of a method.
FIG. 14 shows a flow chart of a method.

FIG. 11 illustrates a flowchart diagram of a method for manufacturing of a textured (curled) monofilament yarn, which can be used as a textured (curled) artificial turf yarn. The method can be executed using devices depicted in FIG. 1. The method begins with process block 600, wherein a monofilament yarn is provided. The monofilament yarn comprises a polymer blend of two or more polymers. As it is mentioned above the polymer blend can comprise immiscible polymers and at least one compatibilizer. Process block 602 is executed after 600. In process block 602 DSC data is received. The data comprises DSC data of a sample of the polymer blend measurement using a DSC system. The data characterizes melting process of different polymers of the blend. The data can further characterize melting processes of different polymorphic modifications of one of the polymers of the blend, if said polymer has polymorphic modifications. The sample can be a sample of the monofilament yarn. Alternatively the sample can be taken from the polymer blend used for manufacturing of the monofilament yarn.

Process block 604 is executed after process block 602. In process block 604 one or more melting temperatures of the monofilament yarn are determined using the DSC data. The determination of the melting temperatures can be performed as described above, by determining baseline, temperatures corresponding to maxima of the DSC curve, etc. Afterwards the desired temperature of the texturing process is determined using the one or more melting temperatures. Process block 606 is executed after process block 604. In process block 606 the monofilament yarn is textured (curled) using the texturing device to provide the textured artificial yarn, the controller 70 is programmed to hold the actual temperature at the determined desired temperature. As it is mentioned above the melting temperature can be a melting temperature of a crystalline fraction of the polymer of the blend. In case with the polymer of the blend has polymorphism, then the melting temperature can be a melting temperature of one of its polymorphic modifications.

The desired temperature can be selected within the following temperature ranges, preferably in the middle of the respective temperature range within which the desired temperature is selected. The temperature range can selected such that a portion of a crystalline fraction of the polymer blend is in a solid state in a process of the texturing (curling) of the monofilament yarn and another portion of the crystalline fraction of the polymer blend is in a molten state. The lower boundary of such a temperature range can be any of the following temperatures depicted on FIGS. 8-10: Ts1, Tm1, Tf1, Tf01, Ts02, Ts2, Ts3, Tm3, Tf3, Ts4, Tm4, Tf4, Ts5. The upper boundary of such a temperature range can be any of the following temperatures depicted on FIGS. 8-10: Tm1, Tf1, Tf01, Ts02, Ts2, Tm2, Tm3, Tf3, Ts4, Tm4, Tf4, Ts5, Tm5. The upper and the lower boundary temperatures have to be selected such that the upper boundary is greater than the lower boundary. Alternatively the upper boundary Tu and the lower boundary Tl can be determined according to the aforementioned equations.

Alternatively, the temperature range can be selected such that a crystalline fraction of one of the polymers is in a solid state in a process of the texturing (curling) of the monofilament yarn and a crystalline fraction of another one of the polymers is in a molten state in the process of the texturing (curling) of the monofilament yarn. The upper boundary of such a temperature range can be Ts02 depicted in FIG. 8 and the lower boundary temperature of such a temperature range can be Tf01 depicted in FIG. 8.

The temperature range can have a lower boundary temperature being greater or equal to one of the melting temperatures, which can be lowest one of the melting temperatures determined in process block 604 (e.g. Tm3). The temperature range can have an upper boundary temperature being less or equal another one of the melting temperatures, which can be the highest one of the melting temperatures determined in process block 604 (e.g. Tm5). According to the DSC data obtained for different polymer blends (in particular for the polymer blend comprising LLDPE and HDPE) an optimal temperature range for texturing (curling) can be 90-110 degrees Celsius.

As it is mentioned above, DSC curves provide plenty of information for determination of the melting temperatures which are used for the determination of the temperature range of the texturing (curling) of the monofilament yarn. For instance, the melting temperature of the polymer can be determined as a minimum temperature at which only a portion of a crystalline fraction of the respective polymer is in a molten state (e.g. Ts1, Tm1, Tf1, Ts2, Tm2, Tf2, Ts3, Tm3, Tf3, Ts4, Tm4, Tf4, Ts5, Tm5, Tf5). In case when the polymer has polymorphism, the melting temperature can be determined as a minimum temperature at which only a portion of its polymorphic modification is in a molten state (e.g. Ts3, Tm3, Tf3 for the melting of the polymorphic modification which melting process corresponds to the peak 215 in FIG. 10; Ts4, Tm4, Tf4 for the melting of the polymorphic modification which melting process corresponds to the peak 216 in FIG. 10). Alternatively or in addition the melting temperature can be determined as a temperature at which the DSC curve has its maximum (e.g. Tm1, Tm2, Tm3, Tm4, Tm5).

With independent of different approaches for selection/determination of the temperature range and/or the desired temperature for the texturing (curling) process, the temperature range and/or the desired temperature are selected such that only a portion of a crystalline fraction of the polymer blend in molten in the texturing (curling) process. With independent of the particular temperature range selected for the texturing process, the desired temperature can be determined as a middle temperature of the temperature range of the texturing process, i.e. as an average value of an upper boundary of the temperature range and lower boundary of the temperature range. In addition or as alternative the desired temperature can be determined as said temperature range or a range within the temperature range, wherein preferably the aforementioned average value is comprised in the range within the temperature range.

The texturing (curling) of the monofilament yarn can be performed for instance using the texturing (curling) device depicted in FIGS. 1, 6 and 7. The device can be operated such that texturing (curling) is made within the temperature range of the texturing process. This can be implemented by setting a desired temperature of the controllers 70 and 162 to the desired temperature determined in process block 604.

Turning back to FIG. 11, an optional process block **606*a* can be executed before process block 606, preferably immediately before 606 process block. In process block 606*a* the temperature of the monofilament yarn is increased to a temperature which is higher than the temperature the texturing process using one or more heating devices (e.g. the heating device 117). The offset of the temperature with respect to the temperature of the texturing process can be selected such, that the temperature of the filament yarn when it enters the texturing device 114** is equal or substantially similar to the temperature of the texturing process. The procedure for determination of the offset value is described above.

Another optional process block 608 can be executed after process block 606, preferably immediately after process block 608. The textured (curled) monofilament yarn is cooled. The cooling can be performed using a cooling godet 120. The cooling can an a quenching procedure, wherein the textured (curled) monofilament yarn can be cooled down to a temperature of 20-25 degrees Celsius within 1-5 seconds.

FIG. 12 illustrates a flow chart diagram of a method for manufacturing of a monofilament yarn, which can be used in the method which flow chart is shown in FIG. 11. The method begins with process block 620. In process block 620 the polymer blend is created. The polymer blend can comprise two different types of polyethylene (e.g. LLDPE and HDPE). The polymer blend can be a more complex system. For instance it can be at least a three-phase system. In this case it can comprise a first polymer, a second polymer and a compatibilizer. The first polymer and the second polymer are immiscible. In other examples there may be additional polymers such as a third, fourth, or even fifth polymer that are also immiscible with the second polymer. There also may be additional compatibilizers which are used either in combination with the first polymer or the additional third, fourth, or fifth polymer. The first polymer forms polymer beads surrounded by the compatibilizer. The polymer beads may also be formed by additional polymers which are not miscible in the second polymer. The polymer beads are surrounded by the compatibilizer and are within the second polymer or mixed into the second polymer.

Process block 622 is executed after process block 620. In process block 622 the polymer blend is extruded into a monofilament yarn. This extrusion can be performed using the extruder 100 depicted in FIG. 1. The polymer blend is feed into the extruder 100 via inlet 101. Inside the extruder 100 the polymers of the polymer blend are completely molten and the individual parts of the blend are homogeneously mixed. The polymer melt is pressed through a spinneret (or a wide slit nozzle) 102, 102*a*, whereby filaments of a specific shape are formed.

Process block 624 is executed after process block 622. The filaments are (rapidly) cooled down to a temperature where crystallization can take place. In the crystallization process the crystallites are forming to a percentage, which depends on the cooling rate. The higher the cooling rate, the less is the crystallinity and vice versa. Process block 624 can be executed using the cooling device 97 depicted in FIG. 1.

Process block 626 is executed after process block 624. In process block 626 the monofilament yarn is drawn e.g. to a factor of 4-6, i.e. the monofilament yarn is elongated 4-6 times. The preferred drawing ratio is 1:5.6. Before and/or during the drawing process the monofilament yarn is heated to a temperature. The temperature can be at least 10-20 degrees Celsius (preferably 70-100 degrees Celsius for a polymer bled comprising Polyamide (PA) and/or Polyethylene (PET)) below the temperature of the last maximum on the DSC curve (e.g. Tm3 in FIG. 10) of the polymer blend used for the manufacturing of the monofilament yarn drawn in process block 626. The temperature of the last maximum on the DSC curve is the temperature being the last in the sequence determined in process block 604. Process block 626 can be executed using the drawing device 115 or 115*a*. The drawing of the monofilament yarn forces the macromolecules to parallelize. This results in a higher degree of crystallinity and increased tensile strength after cooling, compared with undrawn filaments. In addition the drawing process can reshape the polymer beads such that the reshaped beads have thread-like regions.

Process block 628 is executed after process block 626. In process block 628 the monofilament yarn is cooled again. This can be done in the same way as in process block 624. The cooling godet or cooling drum 116 can be used for performing the cooling in process block 628.

Process block 630 is executed after process block 628. In process block 630 the monofilament yarn is drawn e.g. to a factor of 1.1-1.3. The preferable drawing ratio is 1:1.2. During the drawing process the monofilament yarn is heated to a temperature. The temperature can be the same as in Process block 626. Process block 630 can be executed using the drawing device 118. Execution of process block 630 can result in relaxation of stress in the monofilament yarn.

FIG. 13 shows a flowchart which illustrates one method of creating the polymer blend which can be used for manufacturing of the monofilament yarn, e.g. according to the method which flow chart is shown in FIG. 12. In other the other words, the method which flow chart is shown in FIG. 13 can be an extension or alternative of process block 620. In this example the polymer mixture is a three-phase system and comprises the first polymer, a second polymer and the compatibilizer. The polymer blend may also comprise other components such as additives to color or provide flame or UV-resistance or improve the flowing properties of the polymer blend. First in step 640 a first blend is formed by mixing the first polymer with the compatibilizer. Additional additives may also be added during this step. Next in step 642 the first blend is heated. Next in step 644 the first blend is extruded. Then in step 646 the extruded first blend is then granulated or chopped into small pieces. Next in step 648 the granulated first blend is mixed with the second polymer. Additional additives may also be added to the polymer blend at this time. Finally in step 650 the granulated first blend is heated with the second polymer to form the polymer blend. The heating and mixing may occur at the same time. The polymer blend created in process block 650 can be further processed in the same way as the polymer blend created in process block 620.

FIG. 14 shows a flowchart which illustrates a further example of how to create a polymer blend for manufacturing of the monofilament yarn, e.g. according to the method which flow chart is shown in FIG. 12. In other words, the method which flow chart is shown in FIG. 14 can be an extension or alternative of process block 620. In this example the polymer blend additionally comprises at least a third polymer. The third polymer is immiscible with the second polymer and the polymer blend is at least a four-phase system. The third polymer further forms the polymer beads surrounded by the compatibilizer with the second polymer. First in step 660 a first blend is formed by mixing the first polymer and the third polymer with the compatibilizer. Additional additives may be added to the first blend at this point. Next in step 662 the first blend is heated. The heating and the mixing of the first blend may be done at the same time. Next in step 664 the first blend is extruded. Next in step 666 the extruded first blend is granulated or chopped into tiny pieces. Next in step 668 the first blend is mixed with the second polymer. Additional additives may be added to the polymer blend at this time. Then finally in step 670 the heated first blend and the second polymer are heated to form the polymer blend. The heating and the mixing may be done simultaneously. The polymer blend created in process block 670 can be further processed in the same way as the polymer blend created in process block 620.

Figure 15:
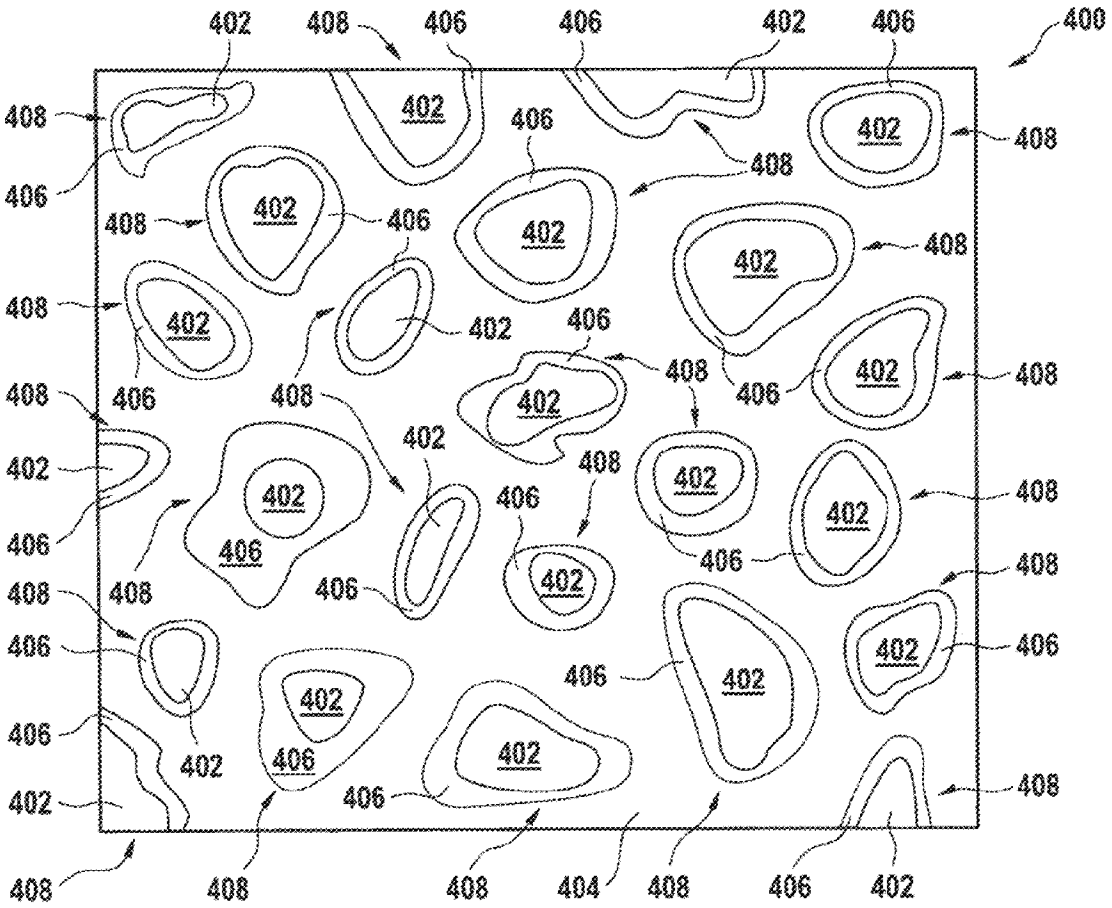
FIG. 15 shows a diagram which illustrates a cross-section of a polymer blend.

FIG. 15 shows a diagram which illustrates a cross-section of a polymer blend 400. The polymer blend 400 comprises a first polymer 402, a second polymer 404, and a compatibilizer 406. The first polymer 402 and the second polymer 404 are immiscible. The first polymer 402 is less abundant than the second polymer 404. The first polymer 402 is shown as being surrounded by compatibilizer 406 and being dispersed within the second polymer 404. The first polymer 402 surrounded by the compatibilizer 406 forms a number of polymer beads 408. The polymer beads 408 may be spherical or oval in shape or they may also be irregularly-shaped depending up on how well the polymer blend is mixed and the temperature. The polymer blend 400 is an example of a three-phase system. The three phases are the regions of the first polymer 402. The second phase region is the compatibilizer 406 and the third phase region is the second polymer 404. The compatibilizer 406 separates the first polymer 402 from the second polymer 406.

Figure 16:
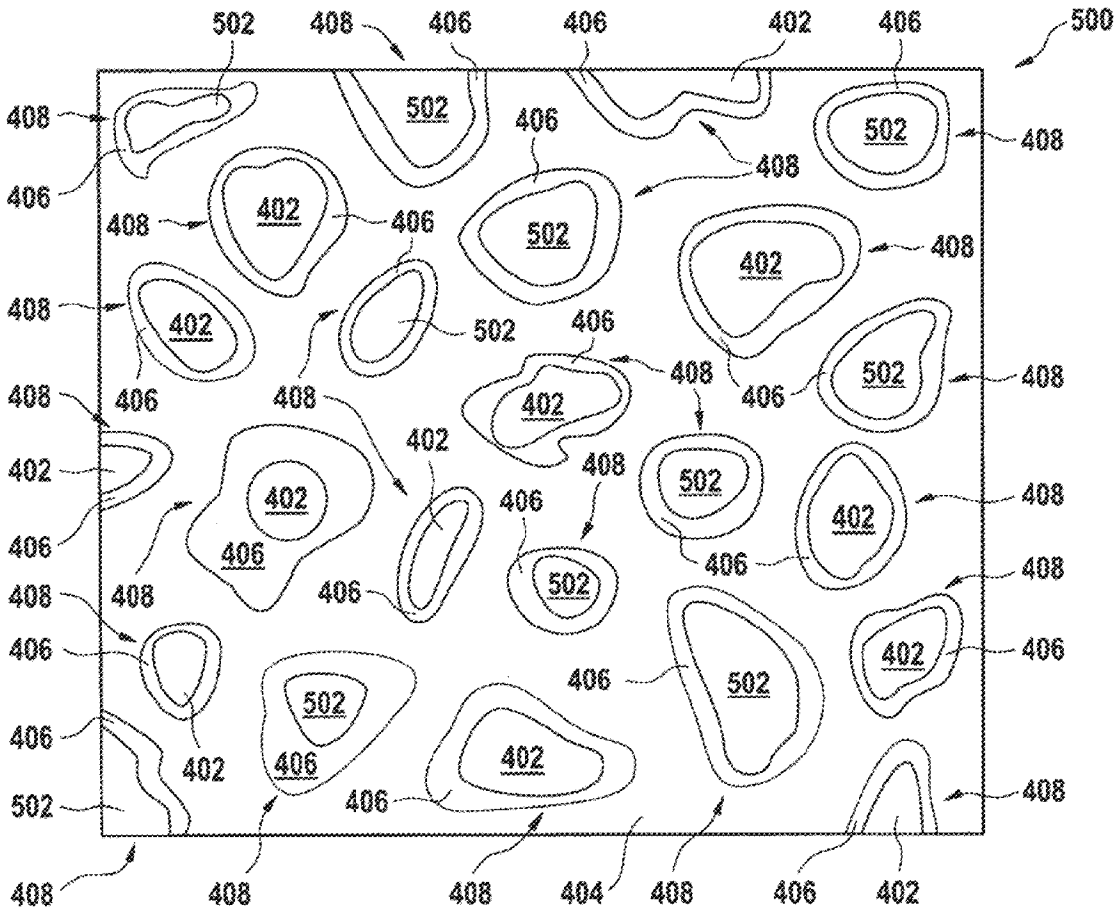
FIG. 16 shows a diagram which illustrates a cross-section of a polymer blend.

FIG. 16 shows a further example of a polymer blend 500. The example shown in FIG. 16 is similar to that shown in FIG. 15 however, the polymer mixture 500 additionally comprises a third polymer 502. Some of the polymer beads 408 are now comprised of the third polymer 502. The polymer blend 500 shown in FIG. 14 is a four-phase system. The four phases are made up of the first polymer 402, the second polymer 404, the third polymer 502, and the compatibilizer 406. The first polymer 402 and the third polymer 502 are not miscible with the second polymer 404. The compatibilizer 406 separates the first polymer 402 from the second polymer 404 and the third polymer 502 from the second polymer 404. In this example the same compatibilizer 406 is used for both the first polymer 402 and the third polymer 502. In other examples a different compatibilizer 406 could be used for the first polymer 402 and the third polymer 502.

The third of the first polymer can be a polar polymer. The third or the first polymer can be for instance polyamide.

Alternatively the third or the first polymer can be polyethylene terephthalate or polybutylene terephthalate.

The polymer blend can comprise between 1% and 30% by weight the first polymer and the third polymer combined. In this example the balance of the weight may be made up by such components as the second polymer, the compatibilizer, and any other additional additives put into the polymer mixture.

Alternatively the polymer blend can comprise between 1 and 20% (or between 5% and 10%) by weight of the first polymer and the third polymer combined. Again, in this example the balance of the weight of the polymer mixture may be made up by the second polymer, the compatibilizer, and any other additional additives.

The polymer blend can comprise between 1% and 30% by weight the first polymer. In this example the balance of the weight may be made up for example by the second polymer, the compatibilizer, and any other additional additives.

Alternatively the polymer blend can comprises between 1% and 20% (or between 5% and 10%) by weight of the first polymer. In this example the balance of the weight may be made up by the second polymer, the compatibilizer, and any other additional additives mixed into the polymer mixture.

The second polymer can be a non-polar polymer. The second polymer can be polyethylene or polypropylene. The polymer blend can comprise between 80-90% by weight of the second polymer. In this example the balance of the weight may be made up by the first polymer, possibly the second polymer if it is present in the polymer mixture, the compatibilizer, and any other chemicals or additives added to the polymer mixture.

The polymer blend (mixture) can further comprise any one of the following: a wax, a dulling agent, a ultraviolet stabilizer, a flame retardant, an anti-oxidant, a pigment, and combinations thereof. These listed additional components may be added to the polymer blend to give the artificial turf fibers made of the textured (curled) monofilament yarn other desired properties such as being flame retardant, having a green color so that the artificial turf more closely resembles grass, greater stability in sunlight, and the aforementioned delayed and/or reduced texture reversion.

The thread-like regions can be embedded in the second polymer of the textured (curled) monofilament yarn. The textured monofilament yarn can comprise a compatibilizer surrounding each of the thread-like regions and separating the first polymer from the second polymer. The thread-like regions can have a diameter of less than 20 (or 10) micrometer. Alternatively the thread-like regions can have a diameter of between 1 and 3 micrometer. The thread-like regions can have a length of less than 2 mm in longitudinal direction of the monofilament yarn.

The textured (curled) monofilament fiber (or the (stretched and) textured monofilament yarn) can be used as artificial turf fiber (yarn) for manufacturing of an artificial turf. The textured (curled) monofilament fiber can be incorporated into an artificial turf backing of the artificial turf. This can be implemented for instance by tufting or weaving the artificial turf fiber (i.e. the textured (curled) monofilament yarn) into the artificial turf backing. After the incorporation of the artificial turf fibers a further optional process can be performed, wherein the artificial turf fibers are bound to the artificial turf backing. For instance the artificial turf fibers may be glued or held in place by a coating or other material. Alternatively a liquid backing (e.g. latex or polyurethane) can be applied on the backside of the artificial turf backing such that the liquid backing wets the lower portions of the fiber and firmly includes the fiber after the solidification of the backing and thus causing a sufficient tuft lock.

Figure 17:
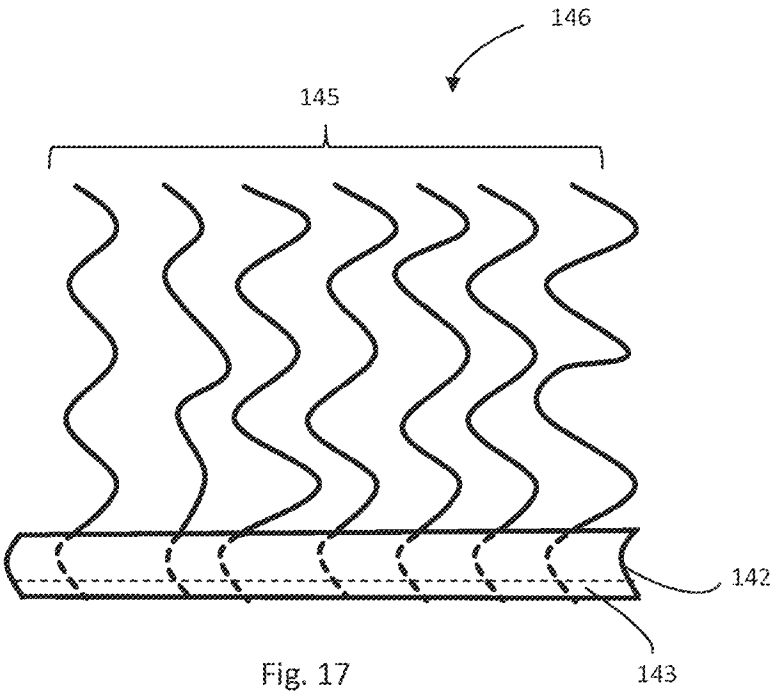
FIG. 17 shows an example of a cross-section of an example of artificial turf.

FIG. 17 shows an example of a cross-section of an example of artificial turf 146. The artificial turf 146 comprises an artificial turf backing 142. Artificial turf fiber 145 has been tufted into the artificial turf backing 142. A coating 143 is shown on the bottom of the artificial turf backing 142. The coating may serve to bind or secure the artificial turf fiber 145 to the artificial turf backing 142. The coating 143 may be optional. For example the artificial turf fibers 145 may be alternatively woven into the artificial turf backing 142. Various types of glues, coatings or adhesives could be used for the coating 143.

The textured artificial turf fiber 145 (or the stretched and textured monofilament yarn) integrated into the turf backing 142, as described above, can be subjected to a mechanical and/or weathering stress, which may cause the aforementioned effect of the texture reversion. The mechanical stress may be caused by sportsmen using the artificial turf for doing sport and/or by sport articles used by the sportsmen, such as a football rolling on the artificial turf. The weathering stress can be caused by the environment conditions in which the artificial turf is used, e.g. temperature, changes in temperature, wind, watering, snowfalls, rains, icing, light illumination, in particular ultraviolet sun light, etc.

The invention claimed is:

1. A method of delaying and reducing texture reversion of a textured artificial turf yarn, the method comprising:

providing a monofilament yarn comprising a polymer mixture, wherein the polymer mixture is at least a three-phase system, wherein the polymer mixture comprises a first polymer, a second polymer, and a compatibilizer, wherein the first polymer and the second polymer are immiscible, wherein the first polymer forms polymer beads surrounded by the compatibilizer within the second polymer;

stretching the monofilament yarn to elongate the polymer beads to increase a volume of a crystalline fraction in the polymer mixture, and to form the monofilament yarn into a stretched monofilament yarn; and texturing the stretched monofilament yarn to form the textured and stretched monofilament yarn, wherein the elongating of the polymer beads and the increasing of the volume of a crystalline fraction delay and reduce the texture reversion of the textured and stretched monofilament yarn, and wherein the texturing of the stretched monofilament yarn includes performing a gas-dynamic texturing process such that a portion of the crystalline fraction of the polymer mixture is in a solid state and another portion of the crystalline fraction of the polymer mixture is in a molten state.

2. The method of claim 1, further comprising:

determining a desired temperature of the gas-dynamic texturing process based on one or more melting temperatures of the monofilament yarn; and holding an actual temperature of the gas-dynamic texturing process at the desired temperature.

3. The method of claim 2, wherein the texturing of the stretched monofilament yarn to form the textured and stretched monofilament yarn is performed in the gas-dynamic texturing process using a texturing apparatus and a controller being programmed to hold the actual temperature of the gas-dynamic texturing process in the texturing apparatus at the desired temperature, wherein the texturing apparatus comprises an inlet for a fluid under pressure for gas-dynamic texturing of the stretched monofilament yarn in the texturing apparatus, the fluid having a temperature above ambient temperature, wherein the texturing apparatus is heated by an apparatus heating device in the gas-dynamic texturing process, wherein the apparatus heating device is configured to heat the texturing apparatus by electromagnetic induction or through physical contact with the texturing apparatus, wherein the controller is configured to control the apparatus heating device such that the actual temperature of the texturing apparatus is held at the desired temperature.

4. The method of claim 3, wherein the controller is configured to control the apparatus heating device for ramping up the temperature of the texturing apparatus from the ambient temperature to the desired temperature.

5. The method of claim 2, wherein the desired temperature of the gas-dynamic texturing process is determined such that the portion of the crystalline fraction of the polymer mixture is in the solid state in the gas-dynamic texturing process and the other portion of the crystalline fraction of the polymer mixture is in the molten state in the gas-dynamic texturing process.

6. The method of claim 2, wherein the one or more melting temperatures is two or more melting temperatures, wherein the desired temperature is determined within a temperature range or the desired temperature is determined as a range within the temperature range, wherein the temperature range has an upper boundary temperature being less or equal to one of the melting temperatures, and wherein the temperature range has a lower boundary temperature being greater or equal to another one of the melting temperatures.

7. The method of claim 2, wherein each of the one or more melting temperatures is a melting temperature of a respective polymer of the polymer mixture.

8. The method of claim 1, wherein the stretched and textured monofilament yarn is integrated into an artificial turf backing to form an artificial turf.

9. The method of claim 1, wherein the first polymer comprises polyamide and the second polymer comprises polyethylene, or the first polymer comprises polyester and the second polymer comprises polyethylene, or the first polymer comprises polyester and the second polymer comprises polypropylene, or the first polymer comprises polyamide and the second polymer comprises polypropylene, or wherein the first polymer is one type of polyethylene and the second polymer is another type of polyethylene.

10. The method of claim 1, the compatibilizer comprises any one of the following: a maleic acid grafted on polyethylene or polyamide; a maleic anhydride grafted on free radical initiated graft copolymer of polyethylene, SEBS, EVA, EPD, or polypropylene with an unsaturated acid or its anhydride such as maleic acid, glycidyl methacrylate, ricinoloxazoline maleinate; a graft copolymer of SEBS with glycidyl methacrylate, a graft copolymer of EVA with mercaptoacetic acid and maleic anhydride; a graft copolymer of EPDM with maleic anhydride; a graft copolymer of polypropylene with maleic anhydride; a polyolefin-graft-polyamide polyethylene or polyamide; and a polyacrylic acid type compatibalizer.

11. The method of claim 1, the method comprising the steps of:

forming a first mixture by mixing the first polymer with the compatibilizer;

heating the first mixture;

extruding the first mixture;

granulating the extruded first mixture to form a granulated first mixture;

mixing the granulated first mixture with the second polymer; and heating the granulated first mixture with the second polymer to form the polymer mixture.

12. The method of claim 1, wherein the polymer mixture is at least a four phase system, wherein the polymer mixture comprises at least a third polymer, wherein the third polymer is immiscible with the second polymer, wherein the third polymer further forms the polymer beads surrounded by the compatibilizer within the second polymer.

13. The method of claim 12, the method comprising the steps of:

forming a first mixture by mixing the first polymer and the third polymer with the compatibilizer;

heating the first mixture;

extruding the first mixture;

granulating the extruded first mixture;

mixing the first mixture with the second polymer; and heating the mixed first mixture with the second polymer to form the polymer mixture.

14. The method of claim 12, wherein the third polymer is any one of the following: polyethylene terephthalate (PET) and polybutylene terephthalate (PBT).

15. The method of claim 1, wherein the polymer mixture further comprises any one of the following: a wax, a dulling agent, a UV stabilizer, a flame retardant, an anti-oxidant, a pigment, and combinations thereof.

16. The method of claim 1, the method comprising the steps of:

extruding the polymer mixture into a monofilament yarn;

quenching the monofilament yarn; and heating the quenched monofilament yarn, wherein the heated monofilament yarn is stretched in the stretching of the monofilament yarn.

17. The method of claim 1, wherein the polymer beads comprise crystalline portions and amorphous portions, and wherein elongating the polymer beads causes an increase in the size of the crystalline portions relative to the amorphous portions.

18. The method of claim 1, wherein the method comprises the steps of:

receiving differential scanning calorimetry, DSC, data of a sample of the polymer mixture;

determining one or more melting temperatures of the monofilament yarn using the DSC data; and determining a desired temperature of the gas-dynamic texturing process using the one or more melting temperatures, wherein the texturing of the stretched monofilament yarn to form the textured and stretched monofilament yarn is performed in the gas-dynamic texturing process using a texturing apparatus and a controller being programmed to hold an actual temperature of the gas-dynamic texturing process in the texturing apparatus at the desired temperature.

19. The method of claim 18, wherein the sample is taken from the polymer mixture or the stretched monofilament yarn.

* * * * *